US006650053B2

(12) United States Patent
Takada et al.

(10) Patent No.: US 6,650,053 B2
(45) Date of Patent: Nov. 18, 2003

(54) SURFACE-DISCHARGE TYPE DISPLAY DEVICE WITH REDUCED POWER CONSUMPTION AND METHOD OF MAKING DISPLAY DEVICE

(75) Inventors: Yuusuke Takada, Katano (JP); Ryuichi Murai, Toyonaka (JP); Akira Shiokawa, Osaka (JP); Katsutoshi Shindo, Higashiosaka (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 97 days.

(21) Appl. No.: 09/769,789

(22) Filed: Jan. 25, 2001

(65) Prior Publication Data

US 2001/0015623 A1 Aug. 23, 2001

(30) Foreign Application Priority Data

| | | |
|---|---|---|
| Jan. 26, 2000 | (JP) | 2000-016736 |
| Jan. 27, 2000 | (JP) | 2000-018411 |
| Mar. 8, 2000 | (JP) | 2000-062843 |
| Apr. 12, 2000 | (JP) | 2000-110261 |

(51) Int. Cl.[7] ..... H01J 17/49
(52) U.S. Cl. ..... 313/586; 313/587; 445/24
(58) Field of Search ..... 313/582, 586, 313/587; 315/169.4; 445/24

(56) References Cited

U.S. PATENT DOCUMENTS

| | | | | |
|---|---|---|---|---|
| 5,909,261 A | * | 6/1999 | Seki et al. | 313/583 |
| 5,952,782 A | * | 9/1999 | Nanto et al. | 313/582 |
| 6,160,345 A | * | 12/2000 | Tanaka et al. | 313/489 |
| 6,232,717 B1 | * | 5/2001 | Oida et al. | 313/112 |
| 6,255,780 B1 | * | 7/2001 | Komaki et al. | 313/586 |
| 6,384,532 B1 | | 5/2002 | Yoshioka et al. | 313/586 |
| 6,525,470 B1 | * | 2/2003 | Amemiya | 313/586 |

FOREIGN PATENT DOCUMENTS

| | | | | |
|---|---|---|---|---|
| EP | 1126499 A2 | * | 8/2001 | H01J/17/49 |
| JP | 57212743 A | * | 12/1982 | H01J/11/02 |
| JP | 10-255665 | | 9/1998 | |
| JP | 1196919 | | 4/1999 | |
| JP | 11120906 A | * | 4/1999 | H01J/9/02 |
| JP | 11-297215 | | 10/1999 | |
| JP | P2000-113827 A | | 4/2000 | |
| JP | 2000-188063 | | 7/2000 | |
| JP | 2000-285811 | | 10/2000 | |
| JP | 2001-135238 | | 5/2001 | |
| WO | WO 02/054440 A1 | * | 7/2002 | H01J/17/49 |

* cited by examiner

*Primary Examiner*—Robert Beatty

(57) ABSTRACT

A surface-discharge type display device is provided that can reduce power consumption during sustain discharge and suppress the occurrence of illumination failures. A display electrode and a display scan electrode are aligned on a substrate, and a dielectric layer is formed on the substrate so as to cover the display electrode and the display scan electrode. An area having a lower relative permittivity than the dielectric layer is formed in an area surrounded on three sides by the display electrode, the display scan electrode, and the substrate. The dielectric layer allows sufficient wall charges for surface discharge to be accumulated, whereas the lower relative permittivity area allows the capacitance between the display electrode and the display scan electrode to be decreased. Accordingly, the power consumption during sustain discharge is reduced without causing illumination failures.

45 Claims, 24 Drawing Sheets

FIG. 26

TABLE1

| SAMPLE NUMBER | SECOND DIELECTRIC LAYER | FORMATION METHOD | SUSTAIN DISCHARGE VOLTAGE (V) | LUMINOUS EFFICIENCY (lm/W) | REQUIRED POWER (W) |
|---|---|---|---|---|---|
| 1 | $Na_2O$-$B_2O_3$-ZnO | METAL MASKING | 245 | 0.61 | 62 |
| 2 | $SiO_2$ | NOZZLE INJECTION | 250 | 0.62 | 58 |
| 3 | $Na_2O$-$B_2O_3$-ZnO | METAL MASKING | 240 | 0.67 | 55 |
| 4 | $Na_2O$-$B_2O_3$-ZnO | NOZZLE INJECTION | 245 | 0.65 | 56 |
| 5 | $SiO_2$ | NOZZLE INJECTION | 250 | 0.65 | 57 |
| 6 | $Na_2O$-$B_2O_3$-ZnO | METAL MASKING | 265 | 0.63 | 57 |
| 7 | $SiO_2$ | NOZZLE INJECTION | 255 | 0.62 | 58 |
| 8 | | | 240 | 0.60 | 66 |

FIG. 27

TABLE2

| SAMPLE NUMBER | DISCHARGE GAS PRESSURE (kPa) | SUSTAIN DISCHARGE VOLTAGE (V) | LUMINOUS EFFICIENCY (lm/W) | REQUIRED POWER(W) |
|---|---|---|---|---|
| 9 | 66.5 | 290 | 0.61 | 35 |
| 10 | 66.5 | 300 | 0.58 | 37 |
| 11 | 320 | 360 | 1.41 | 53 |
| 12 | 66.5 | 290 | 0.62 | 34 |
| 13 | 320 | 370 | 1.53 | 48 |
| 14 | 66.5 | 290 | 0.58 | 35 |
| 15 | 320 | 370 | 1.36 | 55 |
| 16 | 66.5 | 285 | 0.63 | 36 |
| 17 | 320 | 350 | 1.48 | 56 |
| 18 | 66.5 | 340 | 0.50 | 42 |
| 19 | 320 | 430 | 1.18 | 66 |

FIG. 28

TABLE3

| SAMPLE NUMBER | ELECTRODE SHAPE | ASPECT RAT IO | DISCHARGE GAS PRESSURE (kPa) | SUSTAIN DISCHARGE VOLTAGE (V) | LUMINOUS EFFICIENCY (lm/W) | REQUIRED POWER(W) |
|---|---|---|---|---|---|---|
| 20 | RECTANGLE | 0.50 | 66.5 | 320 | 0.72 | 37 |
| 21 | PYRAMID | 0.30 | 66.5 | 315 | 0.71 | 36 |
| 22 | RECTANGLE(W53=40 μm) | 0.50 | 66.5 | 345 | 0.64 | 41 |
| 23 | RECTANGLE(W53=30 μm) | 0.50 | 66.5 | 335 | 0.66 | 42 |
| 24 | RECTANGLE(W53=15 μm) | 0.50 | 66.5 | 320 | 0.71 | 36 |
| 25 | PYRAMID(W53=40 μm) | 0.50 | 66.5 | 340 | 0.61 | 42 |
| 26 | FLAT PLATE | 0.05 | 66.5 | 340 | 0.50 | 42 |

SURFACE-DISCHARGE TYPE DISPLAY DEVICE WITH REDUCED POWER CONSUMPTION AND METHOD OF MAKING DISPLAY DEVICE

BACKGROUND OF THE INVENTION

1. Field of the Invention

The present invention relates to a surface-discharge type display device used for image display or the like, and in particular relates to dielectrics in the display device.

2. Related Art

Among various types of color display devices used for displaying images on computers or televisions, surface-discharge type display devices which use plasma surface discharge processes, such as a PALC (plasma address liquid crystal) and a PDP (plasma display panel), have become a focus of attention as color display devices that enable large-size, slimline panels to be produced. Especially, expectations are running high for the commercialization of PDPs.

FIG. 1 is a partial perspective and sectional view of a conventional, typical PDP, whereas FIG. 2 is an expanded sectional view of part of the PDP shown in FIG. 1, looking at in a direction x.

In FIG. 1, a front glass substrate 11 and a back glass substrate 12 are set facing each other in parallel, with barrier ribs 19 being interposed in between. On the surface of the front glass substrate 11 facing the back glass substrate 12, a plurality of display electrodes 13 and a plurality of display scan electrodes 14 having a stripe shape (only two pairs of them are shown in FIG. 1, with each electrode being about 100 $\mu$m in width and 5 $\mu$m in thickness) are alternately aligned so as to be parallel to each other. The surface of the front glass substrate 11 on which the plurality of display electrodes 13 and the plurality of display scan electrodes 14 have been arranged is then coated with a dielectric layer 15 made of lead glass or the like to insulate each electrode, as shown in FIG. 2. The surface of the dielectric layer 15 is coated with a protective film 16 of magnesium oxide (MgO). This forms a front panel.

On the surface of the back glass substrate 12 facing the front glass substrate 11, a plurality of address electrodes 17 (only four of them are shown in FIG. 1) having a stripe shape are aligned in parallel to each other. The surface of the back glass substrate 12 on which the plurality of address electrodes 17 have been arranged is then coated with a dielectric layer 18 made of lead glass or the like. The barrier ribs 19 are formed between neighboring address electrodes 17. Lastly, phosphor layers 20R, 20G, and 20B in each of the three colors red (R), green (G), and blue (B) are applied to the gaps between neighboring barrier ribs 19 on the dielectric layer 18. This forms a back panel.

Discharge spaces 21 between the front panel and the back panel are filled with an inert gas. The areas within these discharges spaces 21 where the plurality of pairs of electrodes 13 and 14 intersect with the plurality of address electrodes 17 are cells for light emission.

To produce an image display on this PDP, a voltage equal to or greater than a discharge starting voltage is applied to display scan electrodes 14 and address electrodes 17 in cells which are to be illuminated, to induce an address discharge. After wall charges are accumulated on the inner wall of the MgO protective film 16, a pulse voltage is applied to each pair of display electrode 13 and display scan electrode 14 arranged on the same surface, to initiate a sustain discharge in the cells in which wall charges have been accumulated. Due to this sustain discharge, ultraviolet light is generated and excites phosphor layers 20R, 20G, and 20B, as a result of which visible light of the three primary colors red, green, and blue is generated and subjected to an additive process. Hence a full-color display is produced.

Here, the amount of current flowing through each of the display electrodes 13 and display scan electrodes 14 during the sustain discharge is known to be dependent on the capacitance of the dielectric layer 15. The dielectric layer 15 of lead glass, which is commonly used in the art, has a relative permittivity of 9 to 12, and therefore has a high capacitance. Accordingly, a large amount of current flows through each electrode during the sustain discharge, which increases the panel's power consumption.

To overcome this problem, a technique of forming a dielectric layer from a material whose relative permittivity is 8 or lower has been proposed (see Japanese Laid-Open Patent Application H08-77930). According to this technique, the relative permittivity of the dielectric layer is decreased, so that the amount of current at the time of sustain discharge, and therefore the panel's power consumption, can be reduced.

However, when the relative permittivity of the dielectric layer decreases, the capacitance of the dielectric layer decreases, too. If the capacitance is so low that sufficient wall charges cannot be accumulated in the cells which should be illuminated, sustain discharge may not be able to be induced, which results in a failure to fully illuminate the desired cells (hereafter referred to as "illumination failure").

This problem is not confined to PDPs, but may occur in other surface-discharge type display devices such as PALCs that use similar surface discharge processes.

SUMMARY OF THE INVENTION

The present invention aims to provide a surface-discharge type display device that can reduce power consumption without causing illumination failures.

The above object can be fulfilled by a surface-discharge type display device including: a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate.

With this construction, sufficient wall charges are accumulated by the first dielectric layer. Also, since the relative permittivity between the first and second electrodes is low, the amount of current flowing at the time of sustain discharge is reduced. Hence the panel's power consumption is reduced while suppressing the occurrence of illumination failures.

Such an area having a lower relative permittivity than the first dielectric layer may be formed by disposing a second dielectric layer having a lower relative permittivity than the first dielectric layer between the first and second electrodes. The formation of this second dielectric layer may be done using metal masking or nozzle injection.

Alternatively, the lower relative permittivity area may be formed by providing the first dielectric layer with a groove between the first and second electrodes in such a way that the bottom of the groove is closer to the first substrate than the surfaces of the first and second electrodes. Such a groove is filled with a discharge gas whose relative permittivity is about 1, so that the panel's power consumption is reduced. Here, the first dielectric layer may be provided with a hollow instead of the groove. The formation of such a groove or hollow is done using sandblasting or a dielectric paste.

Furthermore, the aspect ratio which is the thickness-to-width ratio of each of the first and second electrodes may be in the range of 0.07 to 2.0. In so doing, not only the discharge spaces are widened but also the opening ratio of the panel is increased, which improves the panel's luminous efficiency.

Thus, the surface-discharge type display device of the invention can reduce the power consumption without causing illumination failures during sustain discharge.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIGS. 26–28 show tables describing the experimental results of various embodiments.

DESCRIPTION OF THE PREFERRED EMBODIMENT(S)

The following is a description of a surface-discharge type display device according to embodiments of the present invention, taking a PDP as an example application.

First Embodiment

A PDP and a PDP-equipped display device of the first embodiment of the invention is described below, with reference to drawings.

(Construction of a PDP 100)

Figure 3:
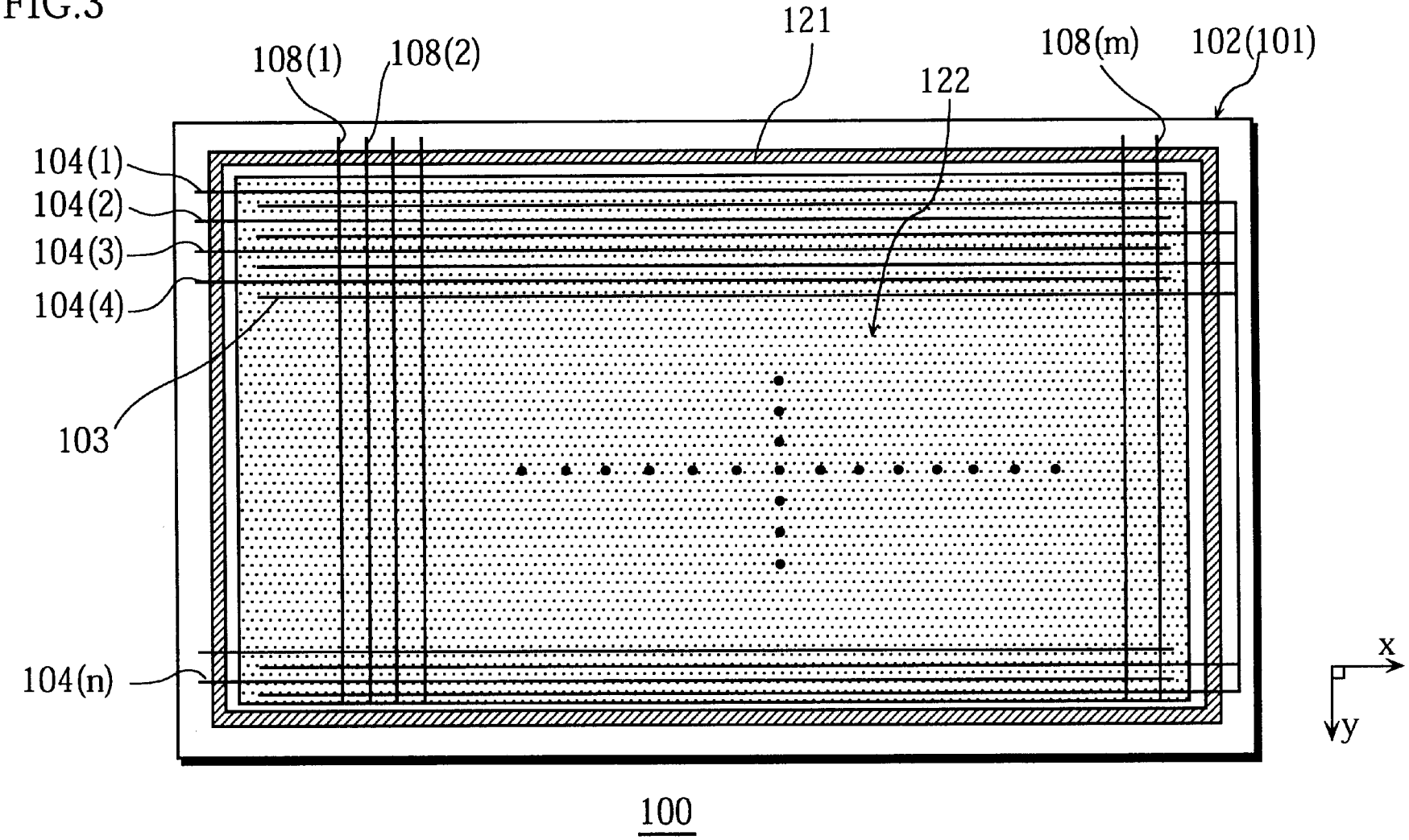
FIG. 3 is a schematic plan view of a PDP according to the first embodiment of the invention, from which a front glass substrate has been removed.
Figure 4:
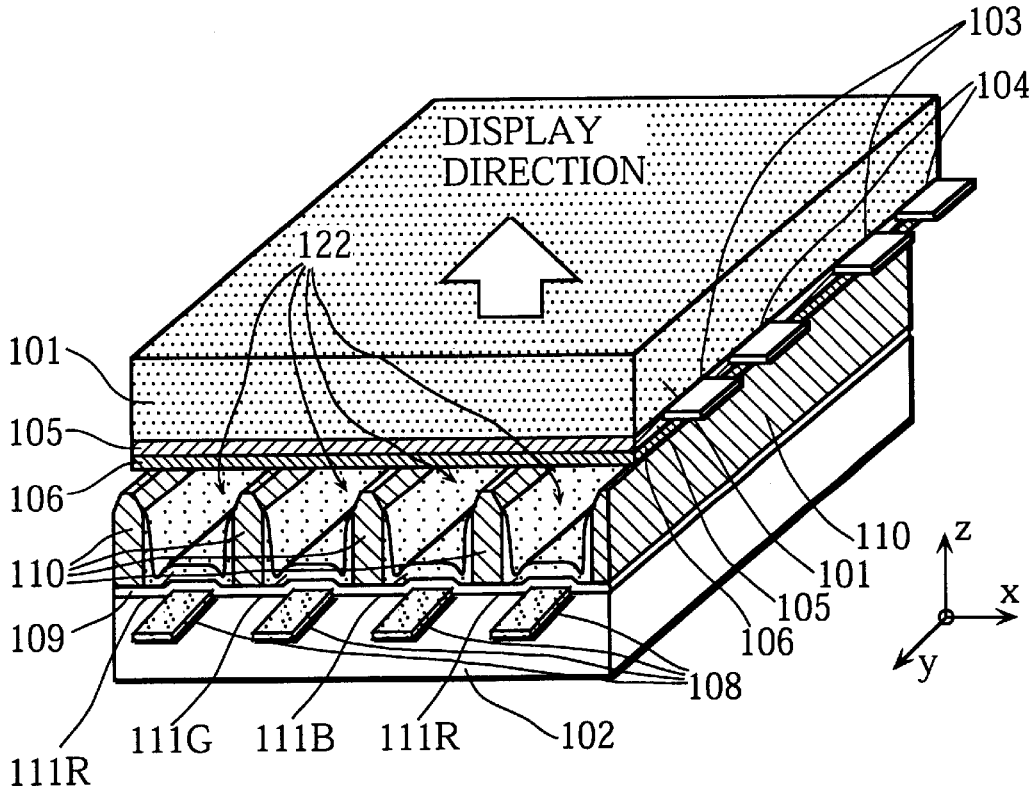
FIG. 4 is a partial perspective and sectional view of the PDP according to the first embodiment.

FIG. 3 is a schematic plan view of a PDP 100 from which a front glass substrate 101 has been removed, whereas FIG. 4 is a partial perspective and sectional view of the PDP 100. Note that in FIG. 3 some of display electrodes 103, display scan electrodes 104, and address electrodes 108 are omitted for simplicity's sake. A construction of this PDP 100 is explained using these drawings.

In FIG. 3, the PDP 100 is roughly made up of a front glass substrate 101 (not illustrated), a back glass substrate 102, n display electrodes 103, n display scan electrodes 104, m address electrodes 108, and an airtight sealing layer 121 (the diagonally shaded area in the drawing). The n display electrodes 103, the n display scan electrodes 104, and the m address electrodes 108 together form a matrix of a three-electrode structure. The areas where the pairs of electrodes 103 and 104 intersect with the address electrodes 108 are cells.

In FIG. 4, the front glass substrate 101 and the back glass substrate 102 are set facing each other in parallel, with stripe-shaped barrier ribs 110 being interposed in between.

The front glass substrate 101, the display electrodes 103, the display scan electrodes 104, a dielectric layer 105, and a protective film 106 constitute a front panel of the PDP 100.

The display electrodes 103 and the display scan electrodes 104 are both made of silver or the like, and are alternately arranged in parallel in stripes on the surface of the front glass substrate 101 facing the back glass substrate 102.

The dielectric layer 105 is made of lead glass or the like, and is formed on the surface of the front glass substrate 101 so as to cover the display electrodes 103 and the display scan electrodes 104.

The protective film 106 is made of MgO or the like, and is formed on the surface of the dielectric layer 105.

The back glass substrate 102, the address electrodes 108, a visible light reflective layer 109, the barrier ribs 110, and phosphor layers 111R, 111G, and 111B constitute a back panel of the PDP 100.

The address electrodes 108 are made of silver or the like, and are aligned in parallel on the surface of the back glass substrate 102 facing the front glass substrate 101.

The visible light reflective layer 109 is made of dielectric glass containing titanium oxide or the like, and is formed on the surface of the back glass substrate 102 so as to cover the address electrodes 108. The visible light reflective layer 109 serves to reflect visible light generated from the phosphor layers 111R, 111G, and 111B, and also serves as a dielectric layer.

The barrier ribs 110 are arranged on the surface of the visible light reflective layer 109 so as to be parallel to the address electrodes 108. The phosphor layers 111R, 111G, and 111B are applied in turn, to the sides of adjacent barrier ribs 110 and the surface of the visible light reflective layer 109 therebetween.

The phosphor layers 111R, 111G, and 111B are made up of phosphor particles that emit light of the respective colors red (R), green (G), and blue (B).

The front panel and the back panel are then sealed together along their edges, by the airtight sealing layer 121. A discharge gas (e.g. a mixture of 95 vol % of neon and 5 vol % of xenon) is enclosed in discharge spaces 122 formed between the front and back panels, at a predetermined pressure (around 66.5 kPa).

Figure 5:
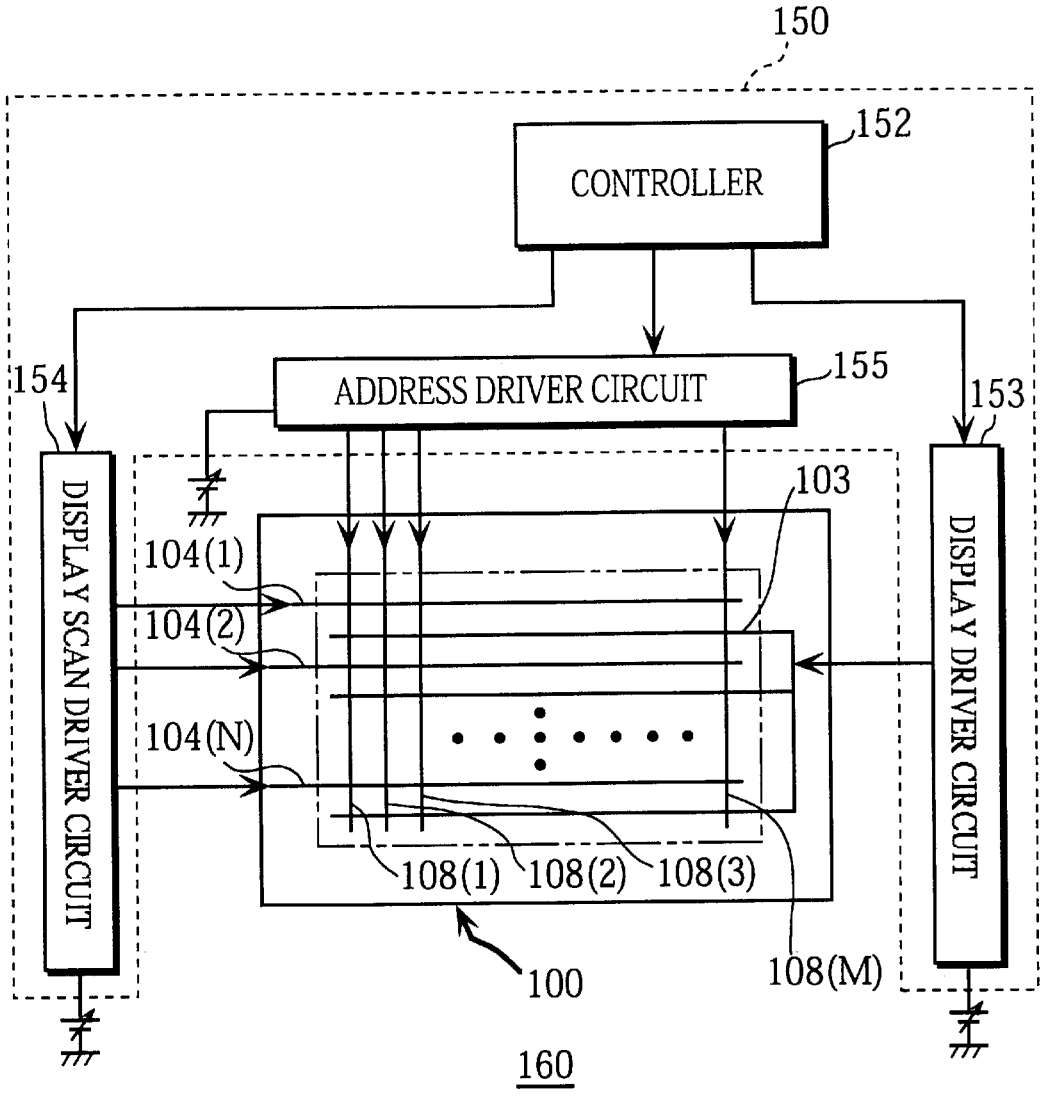
FIG. 5 is a block diagram of a PDP-equipped display device according to the first embodiment.

Such a constructed PDP 100 and a PDP drive device 150 shown in FIG. 5 are connected to each other, thereby forming a PDP-equipped display device 160. To drive the PDP-equipped display device 160, the PDP 100 is connected to a display driver circuit 153, a display scan driver circuit 154, and an address driver circuit 155 in the PDP drive device 150. Under the control of a controller 152, a voltage higher than a discharge starting voltage is applied to display scan electrodes 104 and address electrodes 108 in cells which should be illuminated, to induce an address discharge. After wall charges are accumulated, a pulse voltage is applied to each pair of display electrode 103 and display scan electrode 104 all at once, to initiate a sustain discharge in the cells in which wall charges have been accumulated. Due to this sustain discharge, ultraviolet light is generated from the discharge gas and excites phosphor layers which emit visible light, as a result of which the cells are illuminated. By controlling the presence or absence of illumination of each colored cell in the PDP 100, an image is displayed.

(Construction of the Front Panel)

A construction of the front panel that is characteristic of the invention is explained below.

Figure 6:
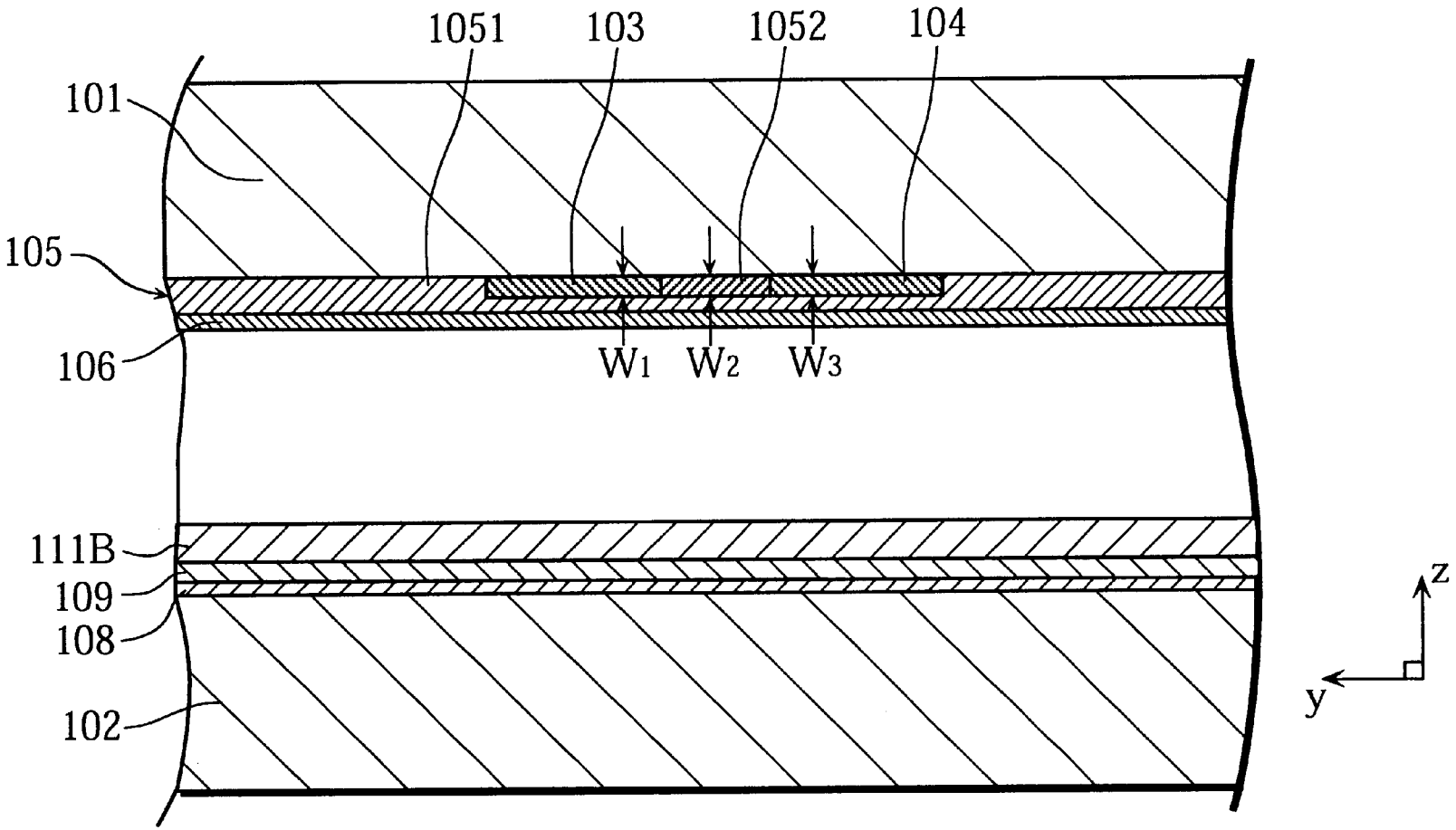
FIG. 6 is an expanded sectional view of part of the PDP shown in FIG. 4, looking at in the direction x.

FIG. 6 is an expanded sectional view of part of the PDP 100 shown in FIG. 4, looking at in the direction x.

As shown in the drawing, the dielectric layer 105 is made up of a first dielectric layer 1051 that covers the entire surface of the front glass substrate 101, and a second dielectric layer 1052 that is disposed between the display electrode 103 and the display scan electrode 104.

The first dielectric layer 1051 is made of a lead dielectric (with a relative permittivity of about 11) containing PbO (75 wt %), $B_2O_3$ (15 wt %), and $SiO_2$ (10 wt %), which is conventionally used for dielectric layers. The first dielectric layer 1051 is formed so as to cover the display electrode 103, the display scan electrode 104, and the second dielectric layer 1052. On the surface of the first dielectric layer 1051 is formed the protective film 106 made of MgO or the like.

The second dielectric layer 1052 is formed so as to fill the gap between the display electrode 103 and the display scan electrode 104, with a thickness W2 which is equal to or larger than the thicknesses W1 and W3 of the display electrode 103 and display scan electrode 104. The second dielectric layer 1052 is made of a material having a lower relative permittivity than the first dielectric layer 1051. For instance, the second dielectric layer 1052 is made of a sodium dielectric which contains $Na_2O$ (65 wt %), $B_2O_3$ (20 wt %), and ZnO (15 wt %) and has a relative permittivity of about 6.5.

(Effects Achieved by the Second Dielectric Layer 1052)

By providing the second dielectric layer 1052 whose relative permittivity is lower than the first dielectric layer 1051 in such a manner as to fill the gap between the display electrode 103 and the display scan electrode 104, an area whose relative permittivity is lower than the first dielectric layer 1051 is formed between the display electrode 103 and the display scan electrode 104. In other words, an area whose relative permittivity is lower than the first dielectric layer 1051 is formed in the area surrounded on three sides by the display electrode 103, the display scan electrode 104, and the front glass substrate 101. As a result, the capacitance between the display electrode 103 and the display scan electrode 104 is decreased.

On the other hand, the surfaces of the display electrode 103 and display scan electrode 104 are covered with the first dielectric layer 1051 whose relative permittivity is high, so that sufficient wall charges are accumulated during address discharge between the address electrode 108 and the display scan electrode 104. This effectively reduces the chance that illumination failures may occur.

When compared with a conventional PDP that forms only one type of dielectric layer on the surface of the front glass substrate, the embodied PDP can reduce the amount of current flowing during sustain discharge without causing illumination failures. Hence the panel's power consumption can be kept lower than that of the conventional PDP.

Here, it is desirable that the second dielectric layer 1052 is formed so as to fill the entire gap between the display electrode 103 and the display scan electrode 104. However, even when the thickness W2 of the second dielectric layer 1052 is smaller than the thicknesses W1 and W3 of the two electrodes 103 and 104, the capacitance between the two electrodes 103 and 104 is decreased to a certain extent, with it being possible to reduce the panel's power consumption.

(Manufacturing Method of the PDP 100)

An example method for manufacturing the front panel of the PDP 100 is described below, with reference to FIG. 7.

Figure 7:
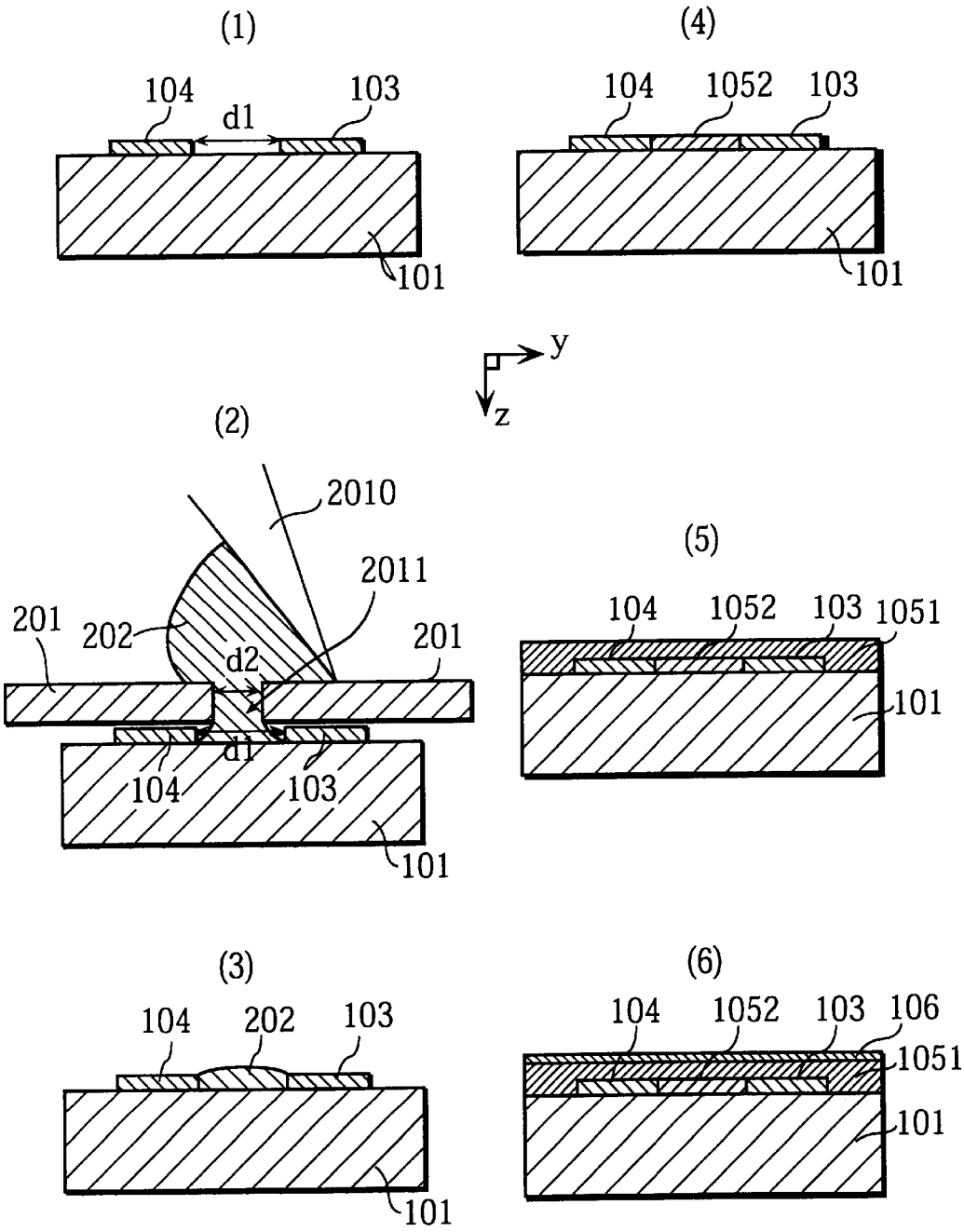
FIG. 7 is a flow diagram showing the process steps (1) to (6) for forming a front panel using metal masking.

FIG. 7 is a flow diagram showing the process steps (1) to (6) for forming the front panel of the PDP 100, where the second dielectric layer 1052 is formed using metal masking. Each process step is illustrated with an expanded sectional view of part of the front panel looked at in the direction x.

(1. Manufacture of the Front Panel)

The front panel is formed as follows. First, the n display electrodes 103 and the n display scan electrodes 104 (only one pair are shown in FIG. 7) having a stripe shape are alternately deposited in parallel on the front glass substrate 101. Then, the dielectric layer 105 is formed on the front glass substrate 101 over the n display electrodes 103 and the n display scan electrodes 104. Lastly, the protective film 106 is formed on the dielectric layer 105.

Here, the display electrode 103 and the display scan electrode 104 are both made of silver or the like. By applying a silver paste (e.g. NP-4028 produced by Noritake Co., Ltd.) to the surface of the front glass substrate 101 at a predetermined spacing d1 (about 80 μm) by screen printing, and then firing the result, the display electrode 103 and the display scan electrode 104 are formed as shown in the step (1) in FIG. 7.

Then, the second dielectric layer 1052 is formed using metal masking in the following way.

In the step (2), a metal plate 201 having a long hole 2011 (a hole extending in the direction x) is positioned so that the long hole 2011 lies directly above the gap between the display electrode 103 and the display scan electrode 104. Here, if the metal plate 201 is made in the same size as the front glass substrate 101, the positioning of the metal plate 201 can be done easily.

Then, a paste 202 containing a sodium dielectric material is applied to the metal plate 201, and a squeegee 2010 is moved to push the paste 202 through the long hole 2011 onto the surface of the front glass substrate 101 between the display electrode 103 and the display scan electrode 104. The width d2 of this long hole 2011 is preferably a little smaller (e.g. 60 μm) than the spacing d1 between the display electrode 103 and the display scan electrode 104, so as to adapt to a case such as where the metal plate 201 is slightly misaligned or where the pitch between the electrodes 103 and 104 is not constant. As an example of the paste 202, a mixture of $Na_2O$ (65 wt %), $B_2O_3$ (20 wt %), ZnO (15 wt %), and an organic binder (10% of ethyl cellulose dissolved in α-terpineol) is used. The organic binder is a substance obtained by dissolving a resin in an organic solvent. A resin such as an acrylic resin and an organic solvent such as butyl carbitol may be used instead of etyle cellulose and α-terpineol. Also, a dispersant (such as glycertrioleate) may be mixed into the organic binder.

After the paste 202 is applied as shown in the step (3), the panel is fired at a predetermined temperature (e.g. 560° C.) for a predetermined period (e.g. 20 minutes), to destroy the organic binder. As a result, the second dielectric layer 1052 with a predetermined thickness (about 20 μm) is formed as shown in the step (4).

Following this, a paste containing a lead glass substance is applied to the front glass substrate 101 using screen printing so as to cover the surfaces of the second dielectric layer 1052, display electrode 103, and display scan electrode 104, and the result is dried and fired. As a result, the first dielectric layer 1051 is formed as shown in the step (5).

Lastly, the protective film 106 is deposited on the surface of the first dielectric layer 1051, as shown in the step (6). The protective film 106 is made of MgO or the like, and is formed using sputtering or CVD (chemical-vapor deposition) so as to have a predetermined thickness (about 0.5 μm).

This completes the formation of the front panel.

Though the second dielectric layer 1052 is formed using metal masking in the above example, the second dielectric layer 1052 may be formed using other methods such as nozzle injection.

Figure 8:
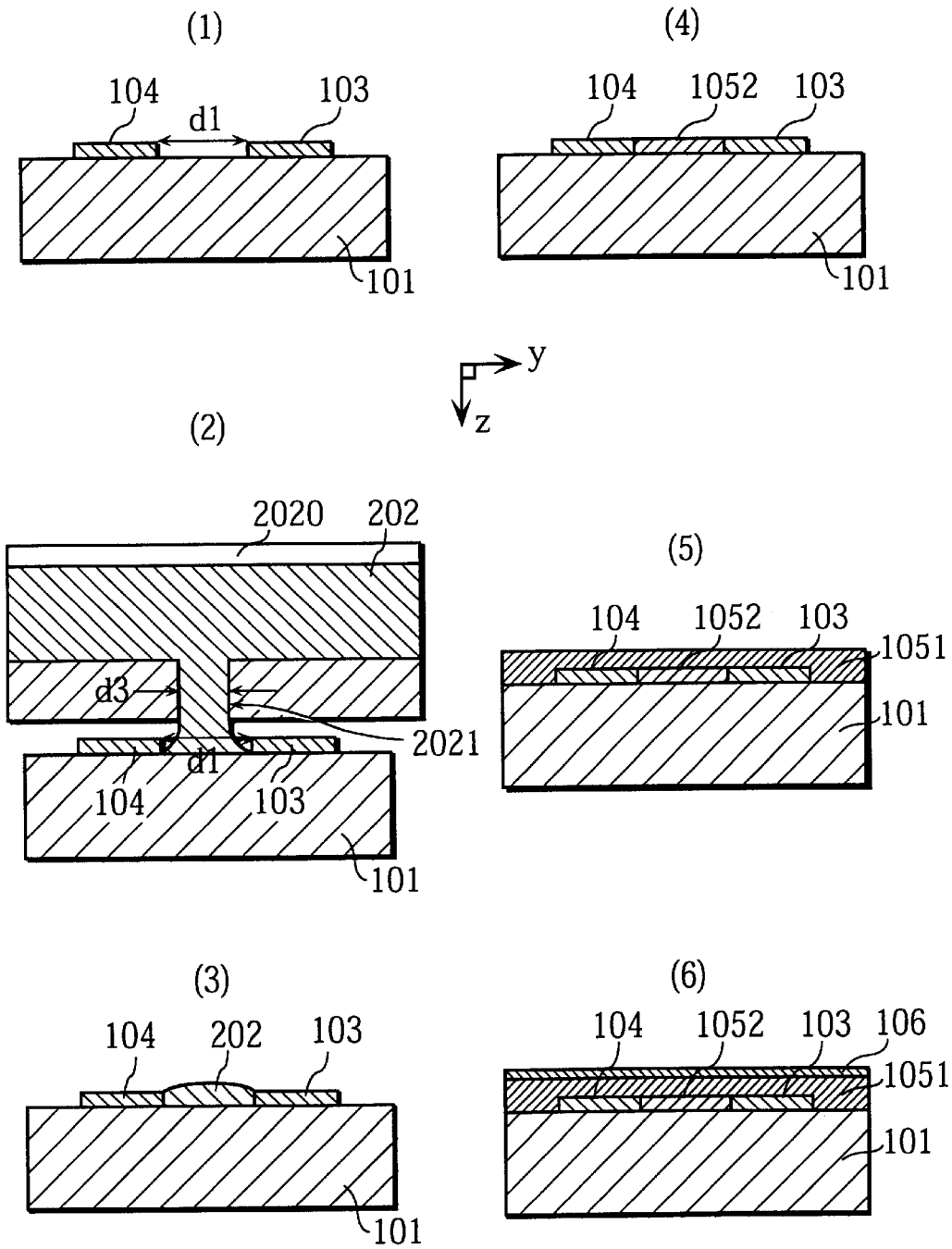
FIG. 8 is a flow diagram showing the process steps (1) to (6) for forming a front panel using nozzle injection.

FIG. 8 is a flow diagram showing the process steps (1) to (6) for forming the front panel of the PDP 100, where the second dielectric layer 1052 is formed using nozzle injection. This method is the same as that shown in FIG. 7 except for the process step (2), so that the explanation of the other process steps is omitted here.

In the step (2) in FIG. 8, a paste injection device 2020 is employed to effect nozzle injection.

The paste injection device 2020 has a movable carriage (not illustrated) and a nozzle orifice 2021 with a diameter d3. While the paste injection device 2020 or the front glass substrate 101 is being moved relative to the other in the direction x by the movable carriage, the paste injection device 2020 injects the paste 202 supplied from a paste supply device (not illustrated) from the nozzle orifice 2021 onto the surface of the front glass substrate 101 between the display electrode 103 and the display scan electrode 104. Here, the diameter d3 of the nozzle orifice 2021 is preferably a little smaller (e.g. 60 μm) than the spacing d1 between the display electrode 103 and the display scan electrode 104, so as to adapt to a case such as where the paste injection device 2020 is slightly misaligned or where the pitch between the electrodes 103 and 104 is not constant.

(2. Manufacture of the Back Panel)

An example method for manufacturing the back panel of the PDP 100 is explained below with reference to FIGS. 3 and 4.

First, a silver paste is applied to the surface of the back glass substrate 102 by screen printing, and then the result is fired to align the m address electrodes 108. Then, a paste containing a lead glass substance is applied to the surface of the back glass substrate 102 over the m address electrodes 108 by screen printing, to form the visible light reflective layer 109. Further, a paste containing the same kind of lead glass substance is repeatedly applied in a predetermined pitch to the surface of the visible light reflective layer 109 by screen painting, and the result is fired to form the barrier ribs 110. With these barrier ribs 110, the discharge space is partitioned in the direction x into the discharge spaces 122 which correspond to individual cells for light emission.

Once the barrier ribs 110 have been formed, a phosphor ink in paste form which is made up of phosphor particles of red (R), green (G), or blue (B) and an organic binder is applied to the sides of neighboring barrier ribs 110 and the surface of the visible light reflective layer 109 exposed between the neighboring barrier ribs 110, and then fired at a temperature of 400–590° C. to destroy the organic binder, as a result of which the phosphor particles are bound together. Hence the phosphor layers 111R, 111G, and 111B are formed.

This completes the formation of the back panel.

(3. Completion of the PDP 100 by Sealing the Front and Back Panels)

The above manufactured front panel and back panel are laminated so that the n pairs of electrodes 103 and 104 intersect with the m address electrodes 108. Sealing glass is interposed between the front and back panels along their edges, and fired at a temperature of around 450° C. for 10 to 20 minutes to form the airtight sealing layer 121. As a result, the front and back panels are fixed together. Once the inside of the discharge spaces 122 has been exhausted to form a high vacuum (e.g. $1.1\times10^{-4}$ Pa), a discharge gas (e.g. an inert gas of He—Xe or Ne—Xe) is enclosed in the discharge spaces 122 at a certain pressure. This completes the PDP 100.

(Phosphor Inks and Phosphor Particles)

In the above manufacturing processes, the phosphor ink which is applied to the back panel is prepared by mixing phosphor particles of one of the three colors, a binder, and a solvent, so as to have a viscosity of 15 to 3000 centipoise. A surfactant, silica, a dispersant (0.1 to 5 wt %), and the like may be added to such a phosphor ink as necessary.

Here, phosphor particles which are common in the art are mixed in the phosphor ink. As red phosphor particles, a compound such as (Y, Gd)$BO_3$:Eu or $Y_2O_3$:Eu is used. In each of these compounds, the element Eu substitutes for part of the element Y in the host material.

As green phosphor particles, a compound such as $BaAl_{12}O_{19}$:Mn or $Zn_2SiO_4$:Mn is used. In each of these compounds, the element Mn substitutes for part of an element in the host material.

As blue phosphor particles, a compound such as $BaMgAl_{10}O_{17}$:Eu or $BaMgAl_{14}O_{23}$:Eu is used. In each of these compounds, the element Eu substitutes for part of the element Ba in the host material.

As the binder which is mixed with the phosphor ink, ethyl cellulose or an acrylic resin (constituting 0.1 to 10 wt % of the ink) is applicable. As the solvent, α-terpineol or butyl carbitol is applicable. Alternatively, a high polymer such as PMA (polymethacrylic acid) or PVA (polyvinyl alcohol) may be used as the binder, and water or an organic solvent such as diethylene glycol or methyl ether may be used as the solvent.

(Modifications to the First Embodiment)

(1) The first embodiment describes the case where the first dielectric layer 1051 is formed so as to entirely cover the surfaces of the display electrode 103, display scan electrode 104, and second dielectric layer 1052. However, given that all the first dielectric layer 1051 needs to cover are the surfaces of the display electrode 103 and display scan electrode 104, the first dielectric layer 1051 may have a gap on the surface of the second dielectric layer 1052.

Figure 9:
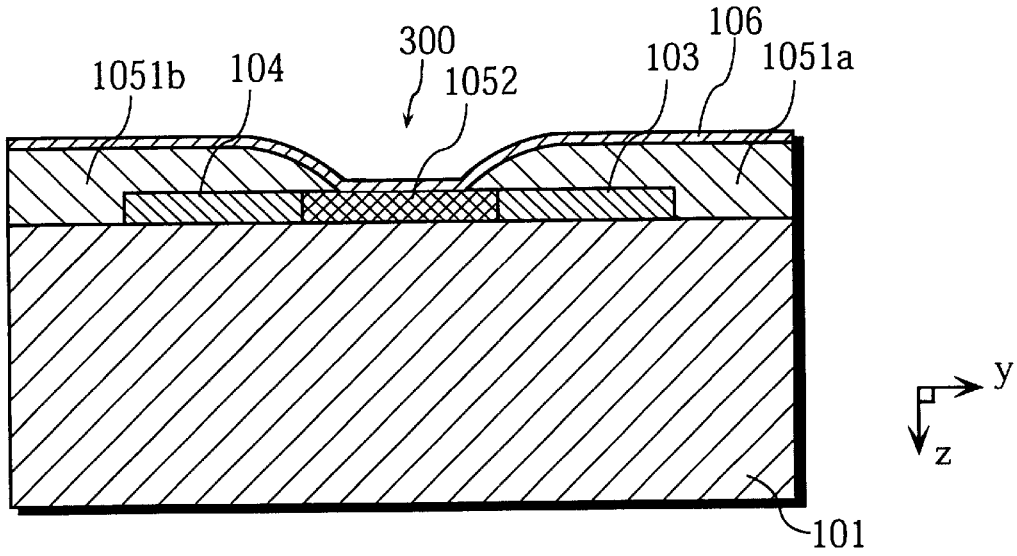
FIG. 9 is a partial expanded sectional view of a modification of the PDP of the first embodiment.

FIG. 9 is an expanded sectional view of part of a front panel according to this modification. Note here that construction elements which are the same as those in the first embodiment shown in FIG. 6 have been given the same reference numerals and their explanation has been omitted.

In the front panel shown in FIG. 9, the first dielectric layer is divided into a first dielectric layer part 1051*a* on the side of the display electrode 103 and a first dielectric layer part 1051*b* on the side of the display scan electrode 104, thereby providing a groove 300 over the second dielectric layer 1052.

This groove 300 is filled with a discharge gas having a relative permittivity of about 1. Accordingly, the capacitance between the display electrode 103 and the display scan electrode 104 decreases when compared with the case where the first dielectric layer is present over the second dielectric layer 1052. This further reduces the amount of current flowing during sustain discharge.

Figure 10:
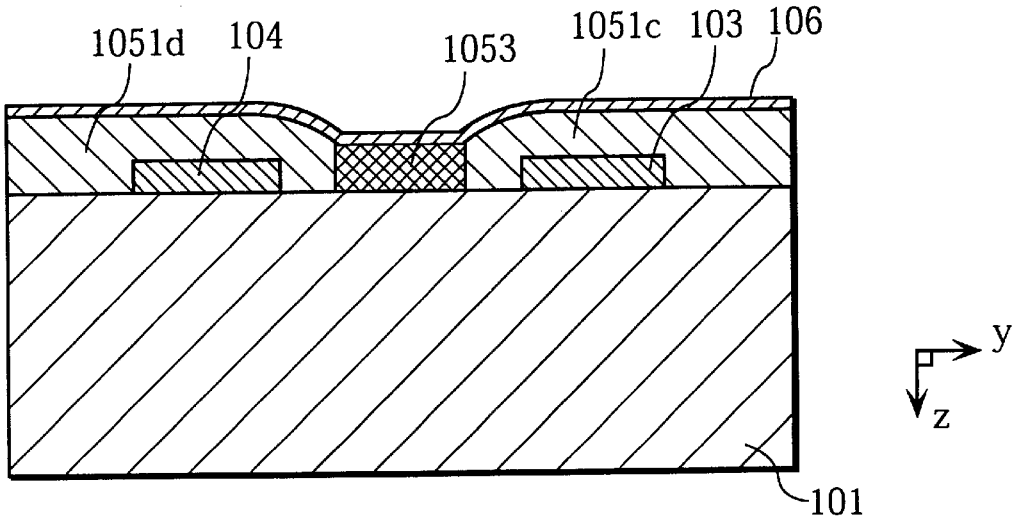
FIG. 10 is a partial expanded sectional view of a modification of the PDP of the first embodiment.

(2) The invention may be further modified so that first dielectric layer parts 1051*c* and 1051*d* are disposed to respectively envelop the display electrode 103 and the display scan electrode 104, and a second dielectric layer 1053 having a lower relative permittivity than the first dielectric layer parts 1051*c* and 1051*d* is disposed between the display electrode 103 and the display scan electrode 104 with the first dielectric layer parts 1051*c* and 105*d* being interposed therebetween, as shown in FIG. 10.

According to this construction, the first dielectric layer parts 1051*c* and 1051*d* whose relative permittivity is high are present between the display electrode 103 and the display scan electrode 104. This causes an increase in capacitance between the two electrodes 103 and 104, and therefore the panel's power consumption will not be reduced as effectively as the first embodiment. Nevertheless, when compared with the prior art, the capacitance is decreased to such an extent that a sufficient reduction in power consumption is realized.

(First Experiment)

(Samples Nos. 1 and 2)

PDP samples Nos. 1 and 2 were prepared with their front panels having the construction of FIG. 6. In the sample No. 1, the second dielectric layer was made of $Na_2O$—$B_2O_3$—ZnO (with a relative permittivity of 6.5) and was formed using metal masking. In the sample No. 2, the second dielectric layer was made of alkoxy silane (OCD type 7 with a relative permittivity of 4, produced by Tokyo Ohka Kogyo Co., Ltd.) and was formed using nozzle injection.

(Samples Nos. 3 to 5)

PDP samples Nos. 3 to 5 were prepared with their front panels having the construction of FIG. 9. In the sample No. 3, the second dielectric layer was made of $Na_2O$—$B_2O_3$—ZnO (with a relative permittivity of 6.5) and was formed by performing an application step, a drying step, and a firing step using metal masking. In the sample No. 4, the second dielectric layer was made of $Na_2O$—$B_2O_3$—ZnO (with a relative permittivity of 6.5) and was formed by performing an application step, a drying step, and a firing step using nozzle injection. In the sample No. 5, the second dielectric layer was made of alkoxy silane (OCD type 7 with a relative permittivity of 4, produced by Tokyo Ohka Kogyo Co., Ltd.) and was formed by repeating an application step and a drying step three times using nozzle injection and then firing the result at 500° C. for 30 minutes.

(Samples Nos. 6 and 7)

PDP samples Nos. 6 and 7 were prepared with their front panels having the construction of FIG. 10. In the sample No. 6, the second dielectric layer was made of $Na_2O$—$B_2O_3$—ZnO (with a relative permittivity of 6.5) and was formed using metal masking. In the sample No. 7, the second dielectric layer was made of alkoxy silane (OCD type 7 with a relative permittivity of 4, produced by Tokyo Ohka Kogyo Co., Ltd.) and was formed using nozzle injection.

(Comparative Sample No. 8)

Figure 1:
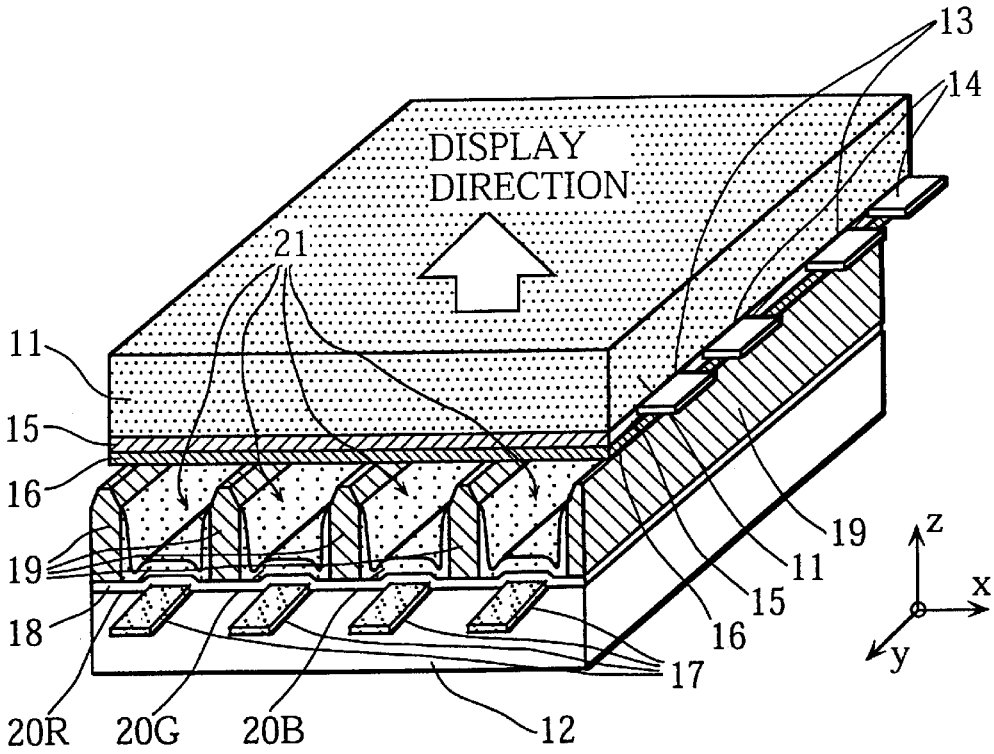
PRIOR ART FIG.1
FIG. 1 is a partial perspective and sectional view of a conventional, typical PDP.
Figure 2:
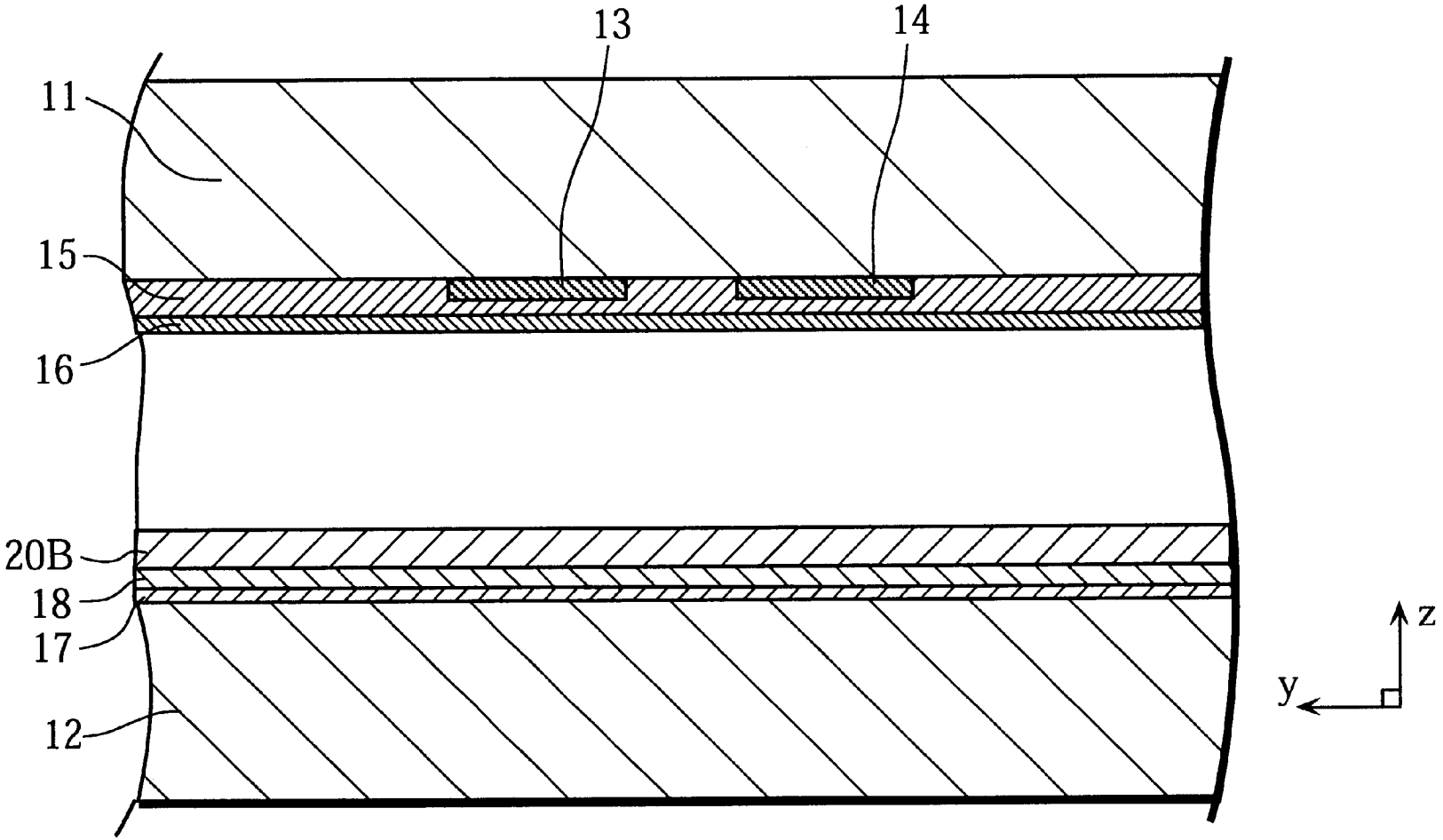
FIG. 2 is an expanded sectional view of part of the PDP shown in FIG. 1, looking at in the direction x.

A PDP sample No. 8 was prepared with its front panel having the construction of FIG. 2.

Each of the samples Nos. 1–8 was in the size of 200 mm×300 mm. Each of the display electrode and the display scan electrode was formed from a silver paste (NP-4028 by Noritake) so as to have a thickness of 5 μm and a width of 80 μm. In each sample, the thickness of the second dielectric layer was 40 μm and the thickness of the MgO protective film was 0.5 μm. A mixture of 95 vol % of neon and 5 vol % of xenon was enclosed in the discharge spaces as a discharge gas, at a pressure of 66.5 kPa.

(Experimental Conditions)

Each of the samples Nos. 1–8 was connected to a PDP drive device of the same construction, and the sustain discharge voltage, the relative luminous efficiency, and the amount of required power at the time of driving the PDP were measured. Here, the input waveform of each of the display electrode and the display scan electrode was a rectangular wave having a frequency of 10 kHz and a duty factor of 10%.

(Results and Consideration)

The experimental results are shown in TABLE 1 (FIG. 26).

As can be seen from the table, the comparative sample No. 8 required 66 W of power, and exhibited a relative luminous efficiency of 0.60 (1 m/W).

On the other hand, each of the samples Nos. 1–7 required less than 66 W of power, demonstrating an approximately 10% or greater reduction in power consumption in comparison with the sample No. 8. Due to this reduction in power consumption, the relative luminous efficiency was improved to 0.61 (1 m/W) or higher. Also, no illumination failures were seen in these samples.

The following conclusion can be drawn from the experimental results. By providing the first dielectric layer having a high relative permittivity to cover the display electrode and the display scan electrode and further providing the second dielectric layer having a lower relative permittivity to the gap between the display electrode and the display scan electrode, sufficient wall charges are accumulated and at the same time the capacitance between the two electrodes is decreased. Hence the power consumption during sustain discharge can be reduced without causing illumination failures.

Second Embodiment

The following is a description of a PDP and a PDP-equipped display device according to the second embodiment of the invention, with reference to drawings.

The PDP and PDP-equipped display device of the second embodiment has a construction similar to those of the first embodiment shown in FIGS. 3 to 5, and differs only in the construction of the front panel. The following description focuses on this difference.

Figure 11:
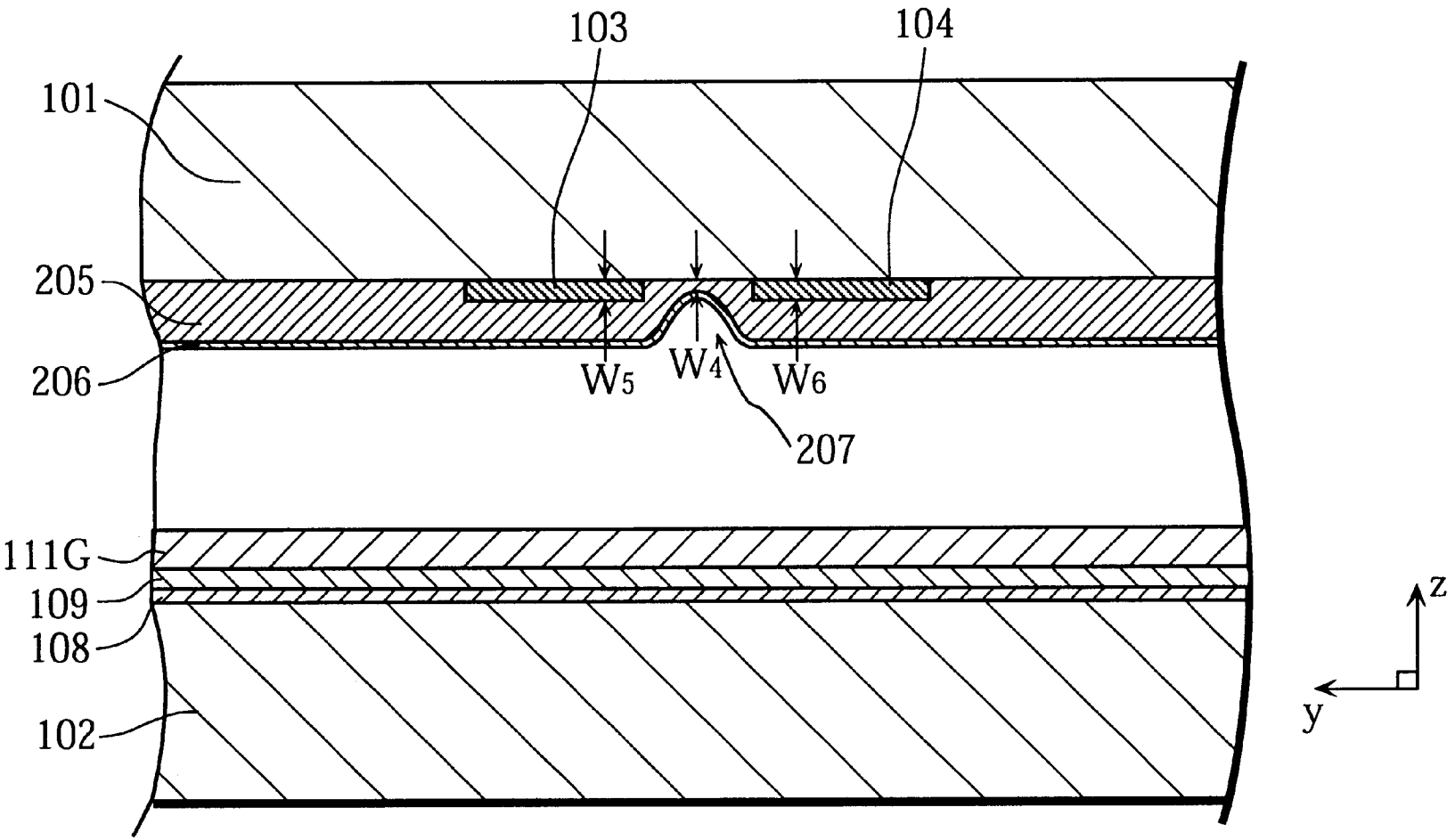
FIG. 11 is an expanded sectional view of part of a PDP according to the second embodiment of the invention, looking at in the direction x.

FIG. 11 is an expanded sectional view of part of the PDP of the second embodiment.

In the drawing, a dielectric layer 205 is formed so as to cover the display electrode 103 and the display scan electrode 104. The surface of this dielectric layer 205 facing the back panel is dented to provide a groove 207 extending in the direction x between the display electrode 103 and the display scan electrode 104.

The dielectric layer 205 has the same composition as the first dielectric layer 1051 in the first embodiment, and shows a relative permittivity of approximately 11. The entire surface of the dielectric layer 205 is coated with a protective film 206 made of MgO or the like.

The groove 207 is provided between the display electrode 103 and the display scan electrode 104 which are covered with the dielectric layer 205, and has a length approximately equal to each of the electrodes 103 and 104. The thickness W4 of the dielectric layer 205 at the bottom of the groove 207 is set to be smaller than the thicknesses W5 and W6 of the display electrode 103 and display scan electrode 104.

Such a groove 207 is part of the discharge spaces 122 and so has an atmosphere in which a certain amount of discharge gas is enclosed in a vacuum. Accordingly, the relative permittivity of the area occupied by the groove 207 is approximately 1. In other words, with the presence of the groove 207, an area whose relative permittivity is lower than the dielectric layer 205 is formed in the area surrounded on three sides by the display electrode 103, the display scan electrode 104, and the front glass substrate 101.

As a result, the panel's power consumption is reduced for the same reason as explained in the first embodiment. Here, since the relative permittivity of the groove 207 is lower than the second dielectric layer 1052 in the first embodiment, the power consumption is reduced by a greater degree than in the first embodiment.

(Manufacture of the Front Panel)

The method of manufacturing the PDP of the second embodiment is the same as that of the first embodiment, except for the manufacture of the front panel, so that the following explanation focuses on this difference.

Figure 12:
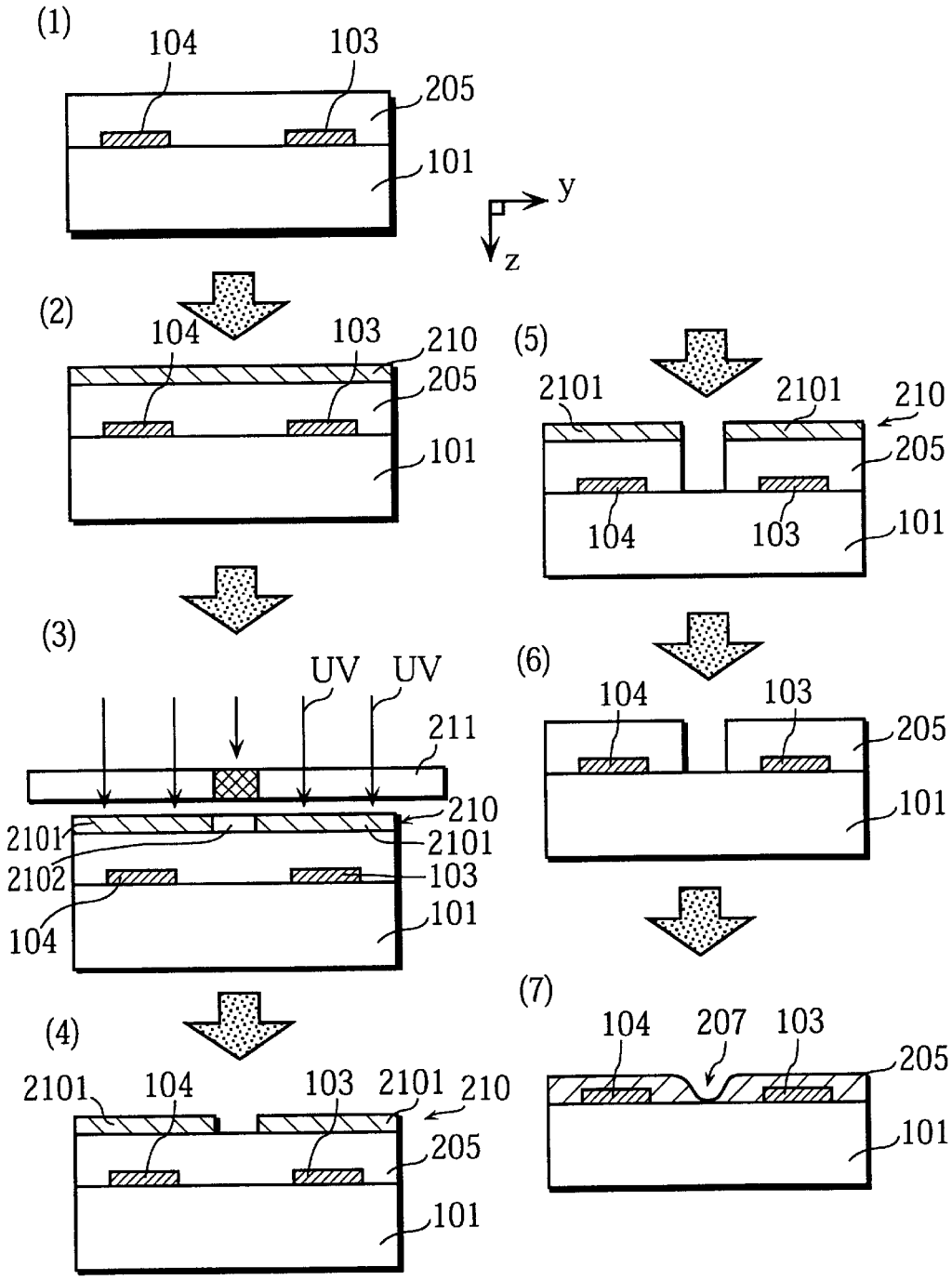
FIG. 12 is a flow diagram showing the process steps (1) to (7) for forming a first dielectric layer using sandblasting.

FIG. 12 is a flow diagram showing the process steps (1) to (7) for forming the groove 207 of the dielectric layer 205 using sandblasting, where each process step is illustrated with an expanded sectional view of part of the front panel looked at in the direction x.

The front panel is manufactured as follows. First, the n display electrodes 103 and the n display scan electrodes 104 (only one pair are shown in FIG. 12) having a stripe shape are alternately disposed in parallel on the front glass substrate 101. Then, the dielectric layer 205 is formed on the front glass substrate 101 over the n display electrodes 103 and the n display scan electrodes 104. Lastly, the protective film 206 is formed on the dielectric layer 205.

Here, the display electrode 103 and the display scan electrode 104 are both made of silver or the like. They are formed by applying a silver paste to the surface of the front glass substrate 101 at a predetermined spacing (about 80 μm) by screen printing, and then firing the result.

Next, the same kind of lead glass paste used for the first dielectric layer 1051 in the first embodiment is applied to the entire surfaces of the front glass substrate 101, display electrode 103, and display scan electrode 104 using screen printing, the result then being dried to form the dielectric layer 205 as shown in the step (1) in FIG. 12.

In the step (2), a resist film 210 is laminated on the surface of the dielectric layer 205. Here, the resist film 210 is preferably formed from a material having an ultraviolet cure property, though this is not a limit for the present invention.

In the step (3), the resist film 210 is exposed to ultraviolet light through a photomask 211 in which the position of the groove 207 is specified, as a result of which the resist film 210 is divided into exposed parts 2101 and an unexposed part 2102. The resist film 210 is then developed to remove the unexposed part 2102 which has not been cured. Hence the pattern shown in the step (4) is obtained.

Such a patterned front panel then undergoes sandblasting. As a result, part of the dielectric layer 205 which is not covered with the exposed parts 2101 is removed as shown in the step (5).

In the step (6), the exposed parts 2101 of the resist film 210 are delaminated, and the result is fired. In so doing, the dielectric layer 205 dries and shrinks. Hence the dielectric layer 205 with the smooth-shaped groove 207 is obtained as shown in the step (7). Lastly, the MgO protective film 206 is formed on the dielectric layer 205 using electron beam evaporation (see FIG. 11). This completes the front panel.

While the above embodiment describes the case where the groove 207 of the dielectric layer 205 is formed using sandblasting, the invention should not be limited to such. For example, the groove 207 may be formed using a photosensitive dielectric paste.

Figure 13:
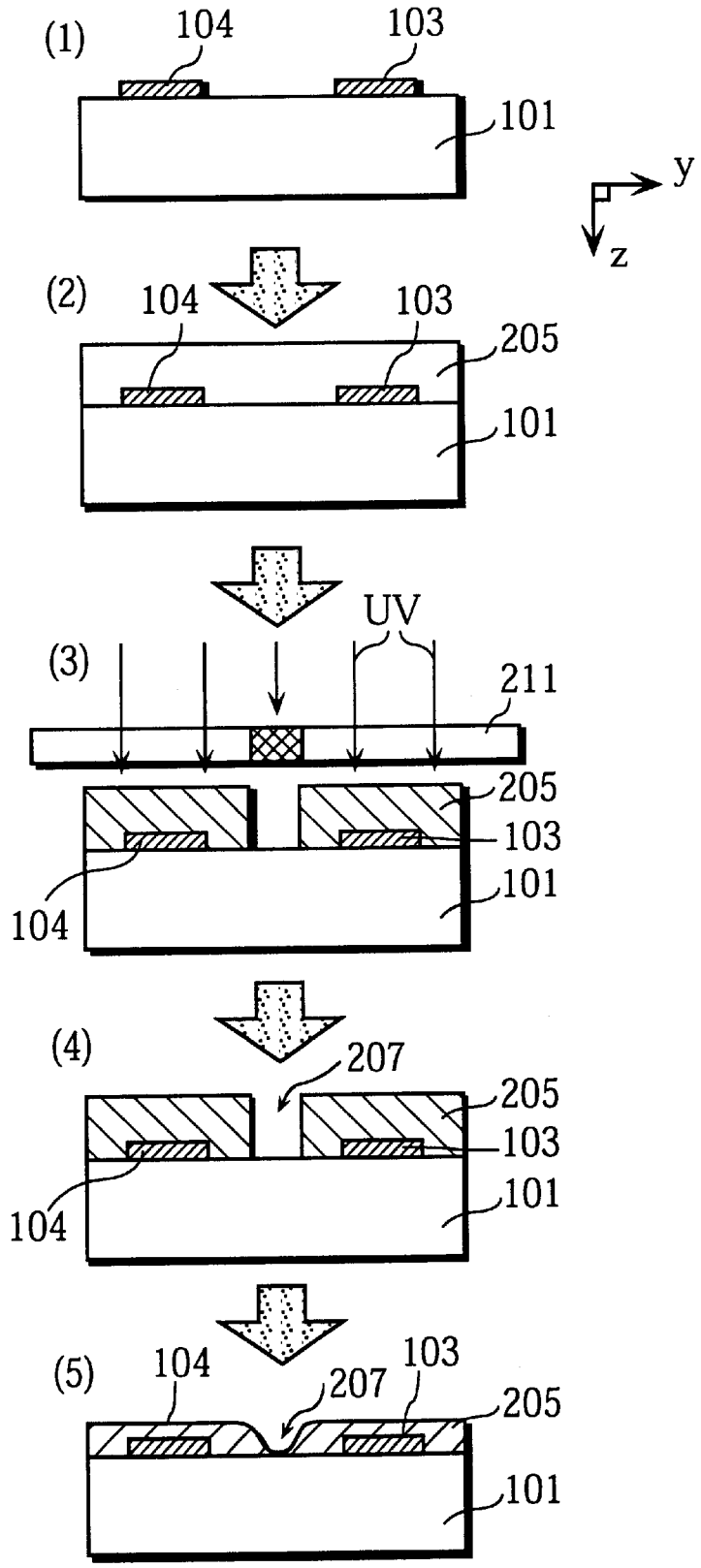
FIG. 13 is a flow diagram showing the process steps (1) to (5) for forming a first dielectric layer using a photosensitive paste.

FIG. 13 is a flow diagram showing the process steps (1) to (5) for forming the groove 207 of the dielectric layer 205 using a photosensitive dielectric paste.

In the step (1), the display electrode 103 and the display scan electrode 104 are formed on the front glass substrate 101 in the same way as in the step (1) in FIG. 12.

In the step (2), the same kind of lead glass paste used for the first dielectric layer 1051 in the first embodiment is mixed with, for example, an ultraviolet photosensitive resin which is photo-curing. The mixture is then applied to the entire surfaces of the display electrode 103, display scan electrode 104, and front glass substrate 101 by screen printing, and the result is dried to form the dielectric layer 205.

In the step (3), the dielectric layer 205 is exposed to ultraviolet light through the same photomask 211 used in the step (3) in FIG. 12, and then developed to remove an unexposed part. Hence the groove 207 is formed as shown in the step (4). After this, the dielectric layer 205 is dried and fired, and as a result shrinks. This completes the dielectric layer 205 with the groove 207 as shown in the step (5).

Lastly, the MgO protective film 206 is formed on the dielectric layer 205 using electron beam evaporation. This completes the front panel.

(Modifications to the Second Embodiment)

(1) The second embodiment describes the case where the display electrode 103 and the display scan electrode 104 are formed directly on the front glass substrate 101 in the front panel. However, the positions of the display electrode 103 and display scan electrode 104 in the front panel are not limited to such. For example, a dielectric layer may be inserted between the front glass substrate 101 and each of the electrodes 103 and 104 to insulate each of the electrodes 103 and 104, with the groove 207 being interposed between the electrodes 103 and 104.

Figure 14:
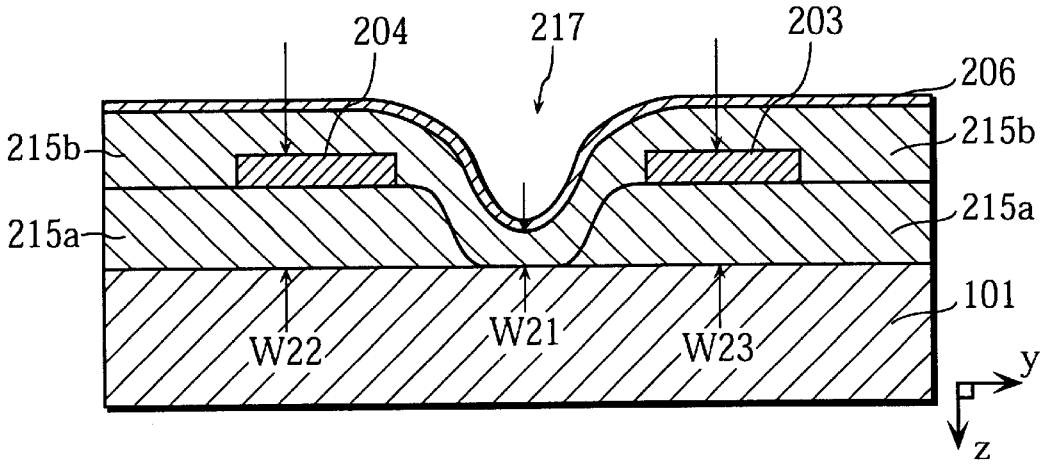
FIG. 14 is a partial expanded sectional view of a modification of the PDP of the second embodiment.

FIG. 14 is an expanded sectional view of part of a front panel according to this modification.

As shown in the drawing, this front panel includes the front glass substrate 101, a display electrode 203, a display scan electrode 204, dielectric layers 215*a* and 215*b*, and the protective film 206.

The dielectric layer 215*a* whose surface has a groove is formed on the surface of the front glass substrate 101. The display electrode 203 is deposited on the dielectric layer 215*a* on one side of the groove, and the display scan electrode 204 is deposited on the dielectric layer 215*a* on the other side of the groove. The dielectric layer 215*b* is formed so as to entirely cover the display electrode 203, the display scan electrode 204, and the dielectric layer 215*a*. As a result, a groove 217 is created above the groove of the dielectric layer 215*a*. Further, the protective film 206 is applied to the entire surface of the dielectric layer 215*b*.

The distance W21 between the front glass substrate 101 and the bottom of the groove 217 is set shorter than the distances W22 and W23 between the front glass substrate 101 and the pair of electrodes 203 and 204. With this setting, an area whose relative permittivity is lower than the dielectric layers 215*a* and 215*b* is formed in the area surrounded on three sides by the display electrode 203, the display scan electrode 204, and the front glass substrate 101, so that the power consumption during sustain discharge is reduced like the second embodiment. Here, the groove 217 can be formed by sandblasting.

(2) Also, the protective film 206 may have a gap between the display electrode 103 and the display scan electrode 104.

Figure 15:
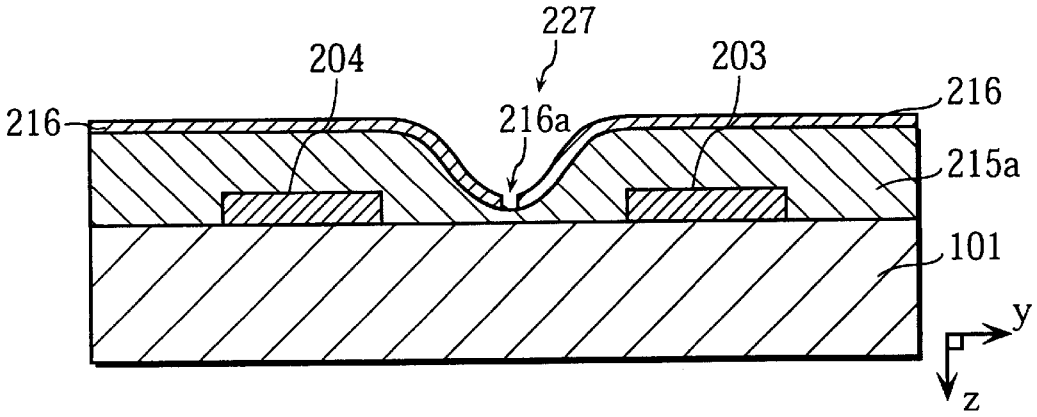
FIG. 15 is a partial expanded sectional view of a modification of the PDP of the second embodiment.

FIG. 15 is an expanded sectional view of part of a front panel according to this modification. In the drawing, a gap 216*a* is provided to a protective film 216 at the bottom of a groove 227. Such a gap 216*a* serves to prevent wall charges from moving on the surface of the protective film 216, so that wall charges accumulated in one cell will not leak to another cell through the protective film 216. This enhances the effects of suppressing illumination failures.

(3) The second embodiment describes the case where the display electrode 103 and the display scan electrode 104 are positioned in parallel with the front glass substrate 101 in the direction z. However, each electrode may be inclined downward on one side facing the other electrode.

Figure 16:
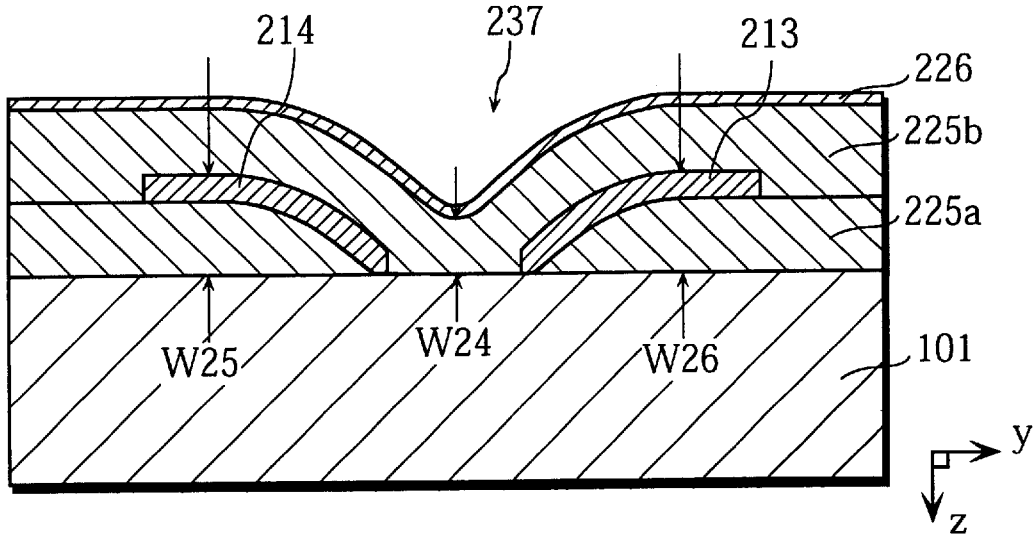
FIG. 16 is a partial expanded sectional view of a modification of the PDP of the second embodiment.

FIG. 16 is an expanded sectional view of part of a front panel according to this modification.

In the drawing, the front panel includes the front glass substrate 101, a display electrode 213, a display scan electrode 214, dielectric layers 225*a* and 225*b*, and a protective film 226.

This front panel can be formed in the following way. First, the dielectric layer 225*a* is formed on the front glass substrate 101 with a predetermined interval using screen printing. Next, the display electrode 213 and the display scan electrode 214 having a strip shape are aligned on the dielectric layer 225*a* using screen printing, so as to lie over the edges of the dielectric layer 225*a* facing the interval. After this, the dielectric layer 225*b* is applied so as to entirely cover the display electrode 213, the display scan electrode 214, and the dielectric layer 225*a*, and then dried and fired. As a result, the edges of the dielectric layer 225*a* shrink, thereby providing a groove 237. Also, the display electrode 213 and the display scan electrode 214 become inclined toward the groove 237. The distance W24 between the front glass substrate 101 and the bottom of the groove 237 (i.e. the thickness of the dielectric layer 225*b* at the bottom of the groove 237) is set shorter than the largest distances W25 and W26 between the front glass substrate 101 and the electrodes 213 and 214. With this setting, an area whose relative permittivity is lower than the dielectric layers 225*a* and 225*b* is formed in the area surrounded on three sides by the display electrode 213, the display scan electrode 214, and the front glass substrate 101. In so doing, the power consumption during sustain discharge is reduced as in the second embodiment.

(Second Experiment)

(Samples Nos. 9 to 11)

PDP samples Nos. 9 to 11 were prepared with their front panels having the construction of FIG. 11. In the sample No. 9, the dielectric layer was made of $PbO—B_2O_3—SiO_2$ (with a mixture ratio of 75 wt %:15 wt %:10 wt %) and was formed using sandblasting. In the sample No. 10, the dielectric layer was made of $PbO—B_2O_3—SiO_2$ (75 wt %:15 wt %:10 wt %) and was formed using a photosensitive dielectric paste. The sample No. 11 had the same construction as the sample No. 9, but the discharge gas pressure was higher (320 kPa).

(Samples Nos. 12 and 13)

PDP samples Nos. 12 and 13 were prepared with their front panels having the construction of FIG. 14. In the sample No. 12, the discharge gas pressure was 66.5 kPa. In the sample No. 13, the discharge gas pressure was 320 kPa.

(Samples Nos. 14 and 15)

PDP samples Nos. 14 and 15 were prepared with their front panels having the construction of FIG. 15. In the sample No. 14, the discharge gas pressure was 66.5 kPa. In the sample No. 15, the discharge gas pressure was 320 kPa.

(Samples Nos. 16 and 17)

PDP samples Nos. 16 and 17 were prepared with their front panels having the construction of FIG. 16. In the sample No. 16, the discharge gas pressure was 66.5 kPa. In the sample No. 17, the discharge gas pressure was 320 kPa.

(Comparative Samples Nos. 18 and 19)

PDP samples Nos. 18 and 19 were prepared with their front panels having the construction of FIG. 2. In the sample No. 18, the discharge gas pressure was 66.5 kPa. In the sample No. 19, the discharge gas pressure was 320 kPa.

Each of the samples Nos. 9–19 was in the size of 200 mm×300 mm. Each of the display electrode and the display scan electrode was formed from a silver paste (NP-4028 by Noritake), so as to have a thickness of 5 $\mu$m and a width of 80 $\mu$m. In each sample, the MgO protective film was formed using electron beam evaporation so as to have a thickness of 0.5 $\mu$m. A mixture of 95 vol % of neon and 5 vol % of xenon was enclosed in the discharge spaces as a discharge gas.

(Experimental Conditions)

Each of the samples Nos. 9–19 was connected to a PDP drive device of the same construction, and the sustain discharge voltage, the relative luminous efficiency, and the amount of required power at the time of driving the PDP were measured. Here, the input waveform of each of the display electrode and the display scan electrode was a rectangular wave having a frequency of 10 kHz and a duty factor of 10%.

(Results and Consideration)

The experimental results are shown in TABLE 2 (FIG. 27).

As can be seen from the table, the sample No. 18 required 340V of voltage and 42 W of power for sustain discharge, and exhibited a relative luminous efficiency of 0.50 (1 m/W).

On the other hand, each of the samples Nos. 9, 10, 12, 14, and 15 required no more than 300 W of voltage and no more than 37 W of power, demonstrating an approximately 10% or greater reduction in sustain discharge voltage and power consumption in comparison with the prior art. Also, no illumination failures were observed in these samples. The effects were similar when the discharge gas pressure was raised.

The following conclusion can be drawn from the experimental results. When a groove is provided between the display electrode and the display scan electrode, sufficient wall charges are accumulated by the presence of the dielectric layer whose relative permittivity is high, and at the same time the capacitance between the two electrodes is decreased by the presence of the groove. Therefore, the power consumption during sustain discharge can be reduced without causing illumination failures.

Third Embodiment

The following is a description of a PDP and a PDP-equipped display device according to the third embodiment of the invention, with reference to drawings.

The PDP and PDP-equipped display device of the third embodiment has a construction similar to those of the first embodiment shown in FIGS. 3 to 5, and differs only in the construction of the front panel. The following description focuses on this difference.

Figure 17:
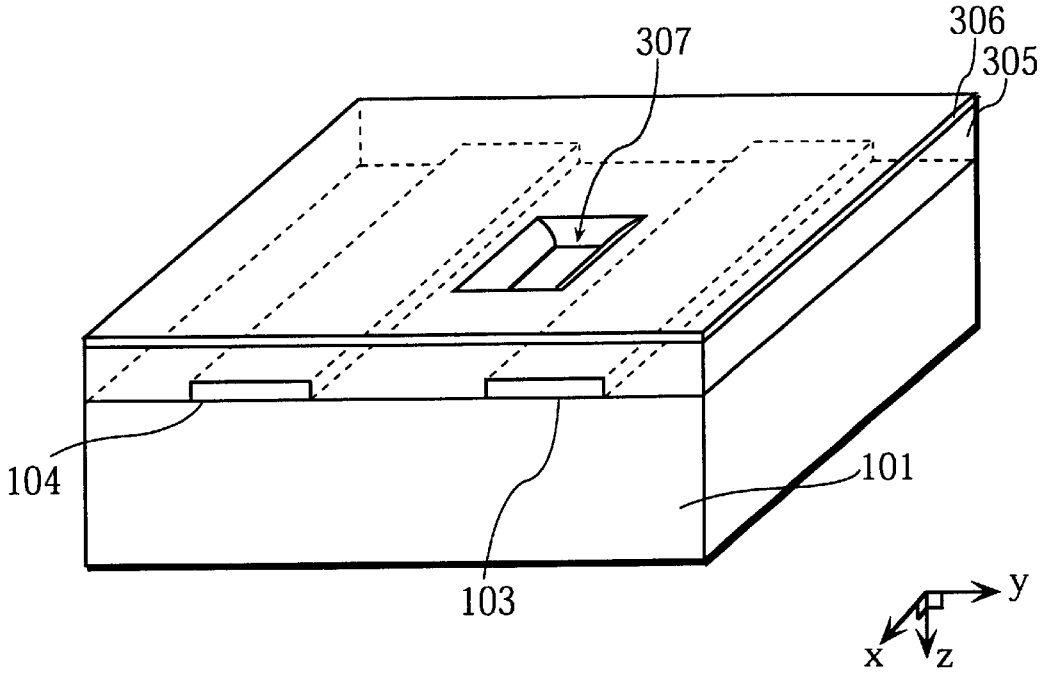
FIG. 17 is a partial perspective and sectional view of a PDP according to the third embodiment of the invention.

FIG. 17 is an expanded perspective view of part of a front panel in the PDP of the third embodiment. The construction elements which are the same as those in the first embodiment shown in FIGS. 3–5 have been given the same reference numerals and their explanation has been omitted.

In the illustrated front panel, the plurality of pairs of display electrodes 103 and display scan electrodes 104 (only one pair is shown in the drawing) are aligned on the front glass substrate 101. A dielectric layer 305 is formed so as to cover the display electrode 103 and the display scan electrode 104. Here, a hollow 307 is provided to part of the dielectric layer 305 which is present between the display electrode 103 and the display scan electrode 104 and which is opposed to an address electrode in a back panel (not illustrated).

The dielectric layer 305 has the same composition as the first dielectric layer 1051 in the first embodiment, and shows a relative permittivity of approximately 11. The entire surface of the dielectric layer 305 is coated with a protective film 306 made of MgO or the like.

The hollow 307 is provided such that the thickness of the dielectric layer 305 at the bottom of the hollow 307 (i.e. the distance between the front glass substrate 101 and the bottom of the hollow 307) is smaller than the thicknesses of the two electrodes 103 and 104 (i.e. the distances between the front glass substrate 101 and the pair of electrodes 103 and 104). Such a hollow 307 forms part of the discharge spaces which are filled with a discharge gas having a low relative permittivity, like the groove 207 in the second embodiment. Which is to say, with the presence of the hollow 307, an area whose relative permittivity is lower than the dielectric layer 305 is formed in the area surrounded on three sides by the display electrode 103, the display scan electrode 104, and the front glass substrate 101. As a result, the panel's power consumption is reduced for the same reason as explained in the second embodiment.

Figure 18:
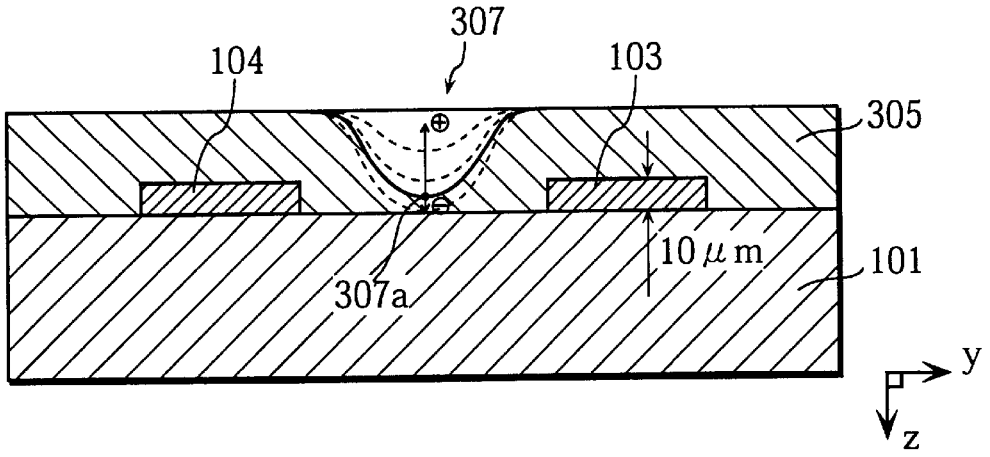
FIG. 18 is an expanded sectional view of part of the PDP of the third embodiment.

FIG. 18 is a sectional view of part of this front panel where the thickness of the dielectric layer 305 at the bottom of the hollow 307 is varied. To optimize this thickness, PDP samples were prepared that differ in the thickness of the dielectric layer 305 at the bottom 307*a* of the hollow 307, and the luminous efficiency and the minimum sustain discharge voltage were measured for each distance between the surface of the pair of electrodes 103 and 104 (both are 10 $\mu$m in thickness) and the bottom 307*a* in the direction z. Here, the direction in which the surface of the dielectric layer 305 at the bottom 307*a* becomes farther from the front glass substrate 101 than the surface of each electrode in the direction z is referred to as a positive direction, whereas the direction in which the surface of the dielectric layer 305 at the bottom 307*a* becomes closer to the front glass substrate 101 than the surface of each electrode in the direction z is referred to as a negative direction. The results are shown in FIG. 19.

Figure 19:
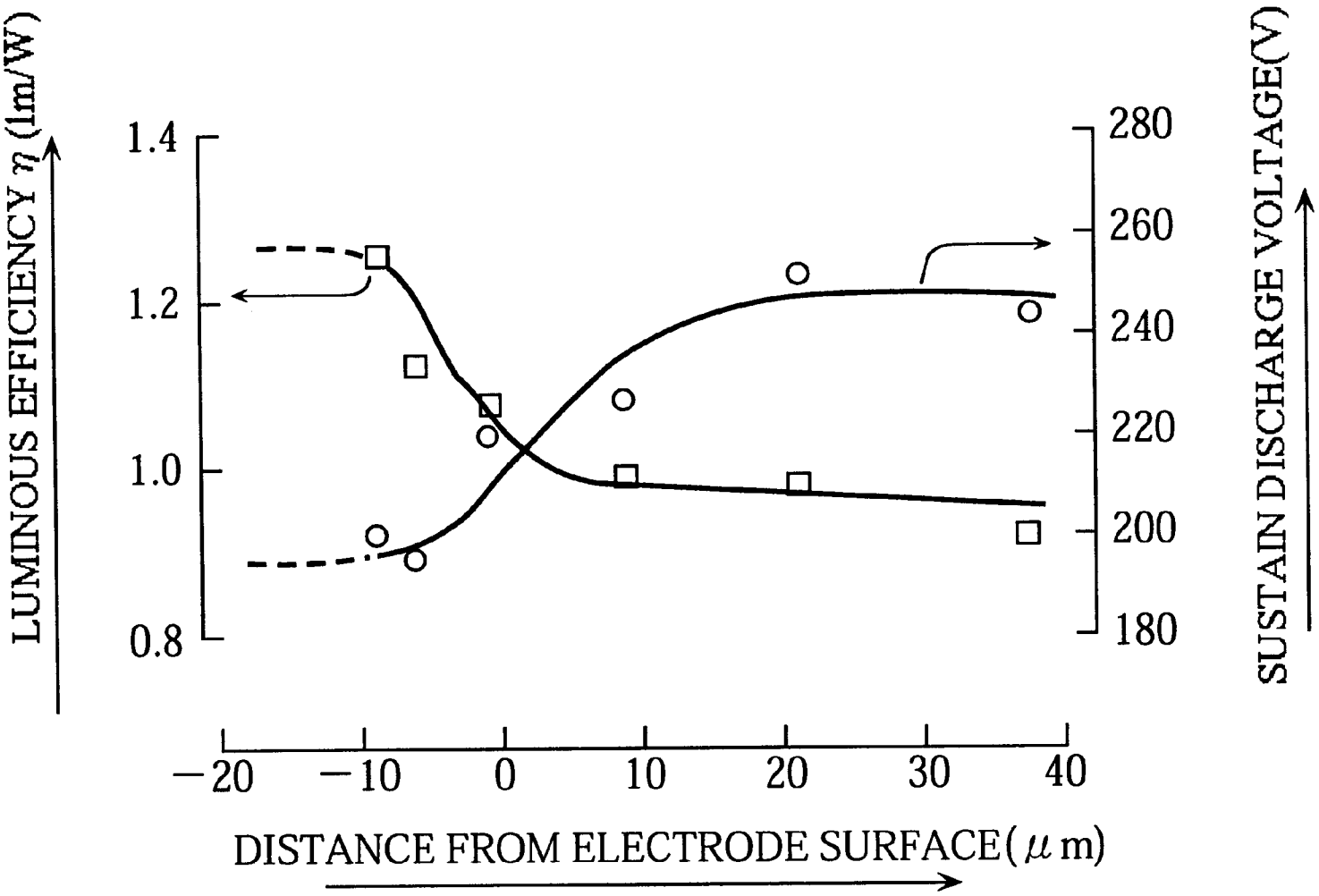
FIG. 19 is a graph showing the panel's luminous efficiency and the sustain discharge voltage, when the depth of the hollow shown in FIG. 18 is varied.

In FIG. 19, as the distance from the surface of each of the electrodes 103 and 104 to the bottom 307*a* in the direction z increases in the negative direction, in other words as the bottom 307*a* becomes closer to the front glass substrate 101 than the electrode surface, the luminous efficiency improves and the minimum voltage required for sustain discharge decreases.

Which is to say, as the hollow 307 becomes bigger, the luminance efficiency and sustain discharge voltage of the panel improves. This is because the hollow 307 forms a discharge space in which a small amount of discharge gas is enclosed in a vacuum, and therefore its relative permittivity is as low as approximately 1, as in the second embodiment.

Such a hollow 307 can be formed using sandblasting or a photosensitive dielectric paste, as explained in the first and second embodiments.

Also, the protective film 306 may be provided with a gap at the bottom of the hollow 307, as in the modification (2) of the second embodiment. In so doing, the same effects as the modification (2) of the second embodiment are attained.

(Modifications to the Third Embodiment)

(1) The third embodiment describes the case where the display electrode 103 and the display scan electrode 104 are shaped in strips, but they may be shaped such that part of each of the electrodes 103 and 104 projects toward the hollow 307 of the dielectric layer 305.

Figure 20:
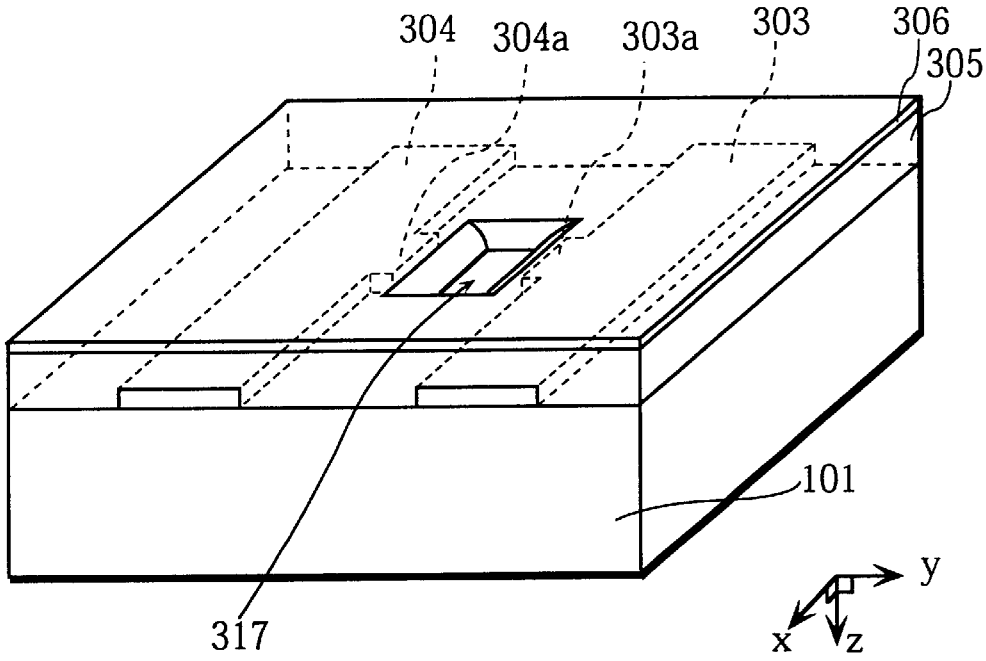
FIG. 20 is a partial perspective and sectional view of a modification of the PDP of the third embodiment.

FIG. 20 is a perspective view of part of a front panel according to this modification.

In this front panel, projections 303*a* and 304*a* are provided respectively to a display electrode 303 and a display scan electrode 304 on both sides of a hollow 317.

With this construction, while the overall distance between the display electrode 303 and the display scan electrode 304 is maintained at a sufficient level, the distance between the two electrodes 303 and 304 in the vicinity of the hollow 317 is made smaller due to the presence of the projections 303*a* and 304*a*. This benefits a decrease in discharge starting voltage and a reduction in power consumption, while ensuring a sufficient discharge area between the two electrodes 303 and 304.

(2) The third embodiment describes the case where the display electrode 103 and the display scan electrode 104 are formed directly on the front glass substrate 101 in the front panel. However, the positions of the display electrode 103 and display scan electrode 104 are not limited to such. For example, a dielectric layer may be inserted between the front glass substrate 101 and each of the electrodes 103 and 104, as in the modification (1) of the second embodiment.

Figure 21:
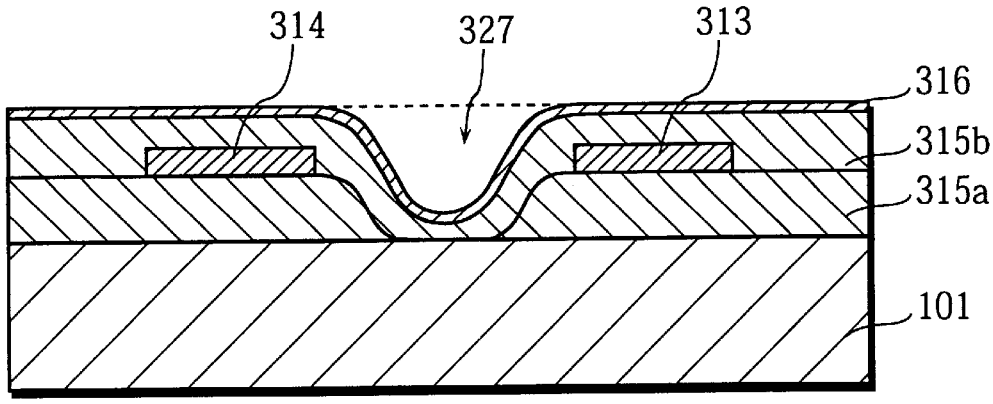
FIG. 21 is a partial expanded sectional view of a modification of the PDP of the third embodiment.

FIG. 21 is an expanded sectional view of part of a front panel according to this modification. In the drawing, a dielectric layer 315*a* whose surface has a hollow is formed on the surface of the front glass substrate 101, and a display electrode 313 and a display scan electrode 314 are deposited on the dielectric layer 315*a*. Then, a dielectric layer 315*b* and a protective film 316 are laminated so as to entirely cover the display electrode 313, the display scan electrode 314, and the dielectric layer 315*a*. As a result, a hollow 327 is created above the hollow of the dielectric layer 315*a*, with it being possible to produce the same effects as the third embodiment.

(3) The third embodiment describes the case where the display electrode 103 and the display scan electrode 104 are positioned in parallel with the front glass substrate 101 in the direction z, though each electrode may be inclined downward on one side facing the other electrode as in the modification (3) of the second embodiment.

Figure 22:
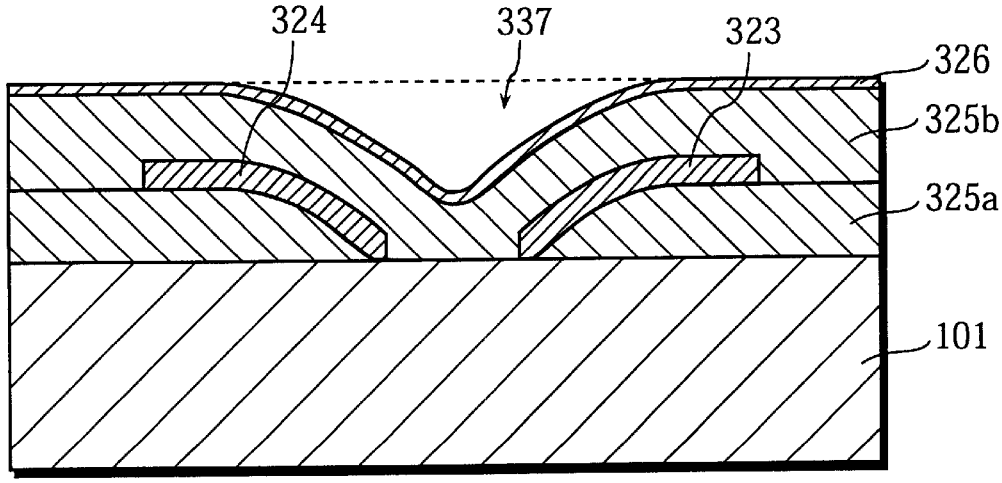
FIG. 22 is a partial expanded sectional view of a modification of the PDP of the third embodiment.

FIG. 22 is an expanded sectional view of part of a front panel according to this modification. In the drawing, a dielectric layer 325*a* is formed on the front glass substrate 101, and a display electrode 323 and a display scan electrode 324 are applied to the dielectric layer 325*a*. Then, a dielectric layer 325*b* is applied, dried, and fired so as to entirely cover the display electrode 323, the display scan electrode 324, and the dielectric layer 325*a*. A protective film 326 is formed on the dielectric layer 325*b*. Here, due to the shrinkage of the edges of the dielectric layer 325*a*, a hollow 337 is created. Also, the side of each electrode facing the other electrode is inclined toward the hollow 337, and becomes closer to the front glass substrate 101 in the direction z. The hollow 337 between the display electrode 323 and the display scan electrode 324 exhibits a low relative permittivity, thereby producing the same effects as the third embodiment.

(4) Though the dielectric layer 305 in the third embodiment is provided with the hollow 307, instead a dielectric layer such as the second dielectric layer in the first embodiment which has a lower relative permittivity than the dielectric layer 305 may be provided to the area corresponding to the hollow 307.

In so doing, an area which exhibits a low relative permittivity is formed in the area surrounded on three sides by the display electrode 303, the display scan electrode 304, and the front glass substrate 101, with it being possible to deliver the same effects as the third embodiment.

Fourth Embodiment

The following is a description of a PDP and a PDP-equipped display device according to the fourth embodiment of the invention, with reference to drawings.

The PDP and PDP-equipped display device of the fourth embodiment has a construction similar to those of the first embodiment shown in FIGS. 3 to 5, and differs only in the construction of the front panel. The following description focuses on this difference.

Figure 23:
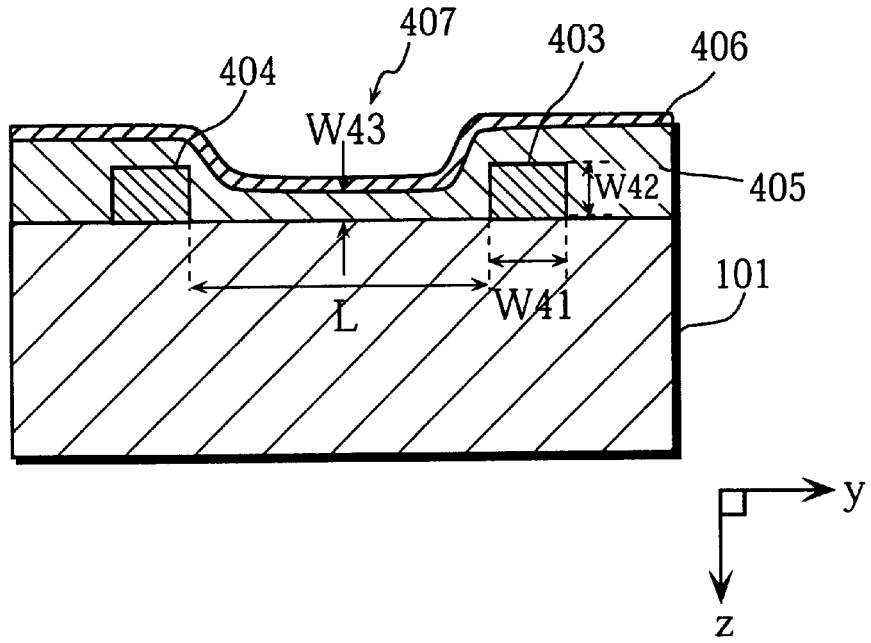
FIG. 23 is an expanded sectional view of part of a PDP according to the fourth embodiment of the invention.

FIG. 23 is an expanded sectional view of part of a front panel of the PDP according to the fourth embodiment.

In this front panel, a plurality of display electrodes 403 and a plurality of display scan electrodes 404 (only one pair of them are shown in FIG. 23) are aligned on the front glass substrate 101 with a predetermined spacing L. A dielectric layer 405 and a protective film 406 are formed on the front glass substrate 101 so as to cover the electrodes 403 and 404. The dielectric layer 405 is provided with a groove 407 which extends along each electrode, in an area surrounded on three sides by the display electrode 403, the display scan electrode 404, and the front glass substrate 101. This construction is the same as the first embodiment, but the fourth embodiment differs with the first embodiment in that the aspect ratio of each of the display electrode 403 and the display scan electrode 404 is specified.

Each of the display electrode 403 and the display scan electrode 404 is rectangular in cross section, and has a width W41 and a thickness W42. Here, the aspect ratio W42/W41 of each of these electrodes is set to be in the range of 0.07 to 2.0, where the thickness W42 is preferably in the range of 3 to 20 $\mu$m. An electrode with such a high aspect ratio can be formed by repeating a printing step and a drying step until a predetermined film thickness is obtained, and then firing the result.

The aspect ratio of each of the display electrode 403 and the display scan electrode 404 is set to be 0.07 or higher for the following reason. If the aspect ratio is lower than 0.07, the electrical resistance of the electrode becomes unstable, which renders the electrode unfit for its intended use. This has been demonstrated by experiment. To stabilize the electrical resistance, the aspect ratio is preferably 0.15 or higher. On the other hand, if the aspect ratio exceeds 2.0, the electrical resistance increases, which causes an increase in the panel's power consumption. This has been experimentally demonstrated, too.

On the other hand, the thickness W42 of each of the display electrode 403 and the display scan electrode 404 is set to be no greater than 20 $\mu$m for the following reason. When the electrode is formed using a thin film formation process or a thick film formation process which are common in the art, the electrode cannot be made thicker than 20 $\mu$m. In the thin film formation process it is difficult to form a thick film, whereas in the thick film formation process a film thickness changes during a firing step and so a predetermined shape cannot be maintained. Meanwhile, the reason why the thickness W42 is set to be no smaller than 3 $\mu$m is that a film thickness smaller than 3 $\mu$m causes a sharp increase in electrical resistance, thereby rendering the electrode unusable. Therefore, the thickness W42 of each of the display electrode 403 and the display scan electrode 404 is preferably in the range of 3–20 $\mu$m. In view of this thickness W42 as well as the electrical resistance and the panel's opening ratio, the width W41 of each of the display electrode 403 and the display scan electrode 404 is preferably in the range of 43 to 70 $\mu$m.

The dielectric layer 405 has the same composition as the first dielectric layer 1051 in the first embodiment, and shows a relative permittivity of approximately 11.

The groove 407 is provided such that the thickness W43 of the dielectric layer 405 at the bottom of the groove 407 (i.e. the distance between the bottom of the groove 407 and the front glass substrate 101) is smaller than the thickness W42 of each of the display electrode 403 and the display scan electrode 404. This groove 407 forms part of discharge spaces which are filled with a discharge gas of a low relative permittivity, like the groove 207 in the second embodiment.

As a result, the panel's power consumption is reduced for the same reason as explained in the second embodiment.

Also, the aspect ratio W42/W41 of each of the display electrode 403 and the display scan electrode 404 ($0.07 \leqq W42/W41 \leqq 2.0$) is higher than that of an electrode in the conventional art (about 0.05). Accordingly, if the cross-sectional area of each of the electrodes 403 and 404 is equal to that of the conventional electrode, the width W41 can be made smaller. Since each of the electrodes 403 and 404 are made of a metal with a low visible light transmittance, the shielding area of the electrode in the visible light transmission direction can be decreased by making the width W41 smaller. Even when the cell pitch between the display electrode 403 and the display scan electrode 404 is small, the required spacing L between the two electrodes 403 and 404 can be secured within the cell of the limited size. As a result, the panel's opening ratio increases and the discharge spaces become wider, with it being possible to improve the luminous efficiency of the panel.

Moreover, given that each of the display electrode 403 and the display scan electrode 404 having a high aspect ratio is thicker than the conventional electrode, the area of one of the electrodes facing the other increases. Accordingly, by forming the deep groove 407, the volume of the discharge space interposed between the display electrode 403 and the display scan electrode 404 increases. As a result, a high electric field strength is attained in a wide space between the two electrodes 403 and 404. This decreases the discharge starting voltage at the time of sustain discharge when compared with the conventional art, so that the panel's power consumption is further reduced.

Here, the groove 407 can be formed using sandblasting or a photosensitive dielectric paste, as explained in the first and second embodiments.

(Modifications to the Fourth Embodiment)

(1) The fourth embodiment describes the case where the display electrode 403 and the display scan electrode 404 are rectangular in cross section. However, each electrode may be pyramidal in cross section such that its width becomes narrower as the distance from the front glass substrate 101 in the direction z increases. Such a pyramidal-shaped electrode can be formed by applying several coats of an electrode paste using screen printing, where the coat width is narrowed each time the printing and drying of the paste is repeated.

Figure 24:
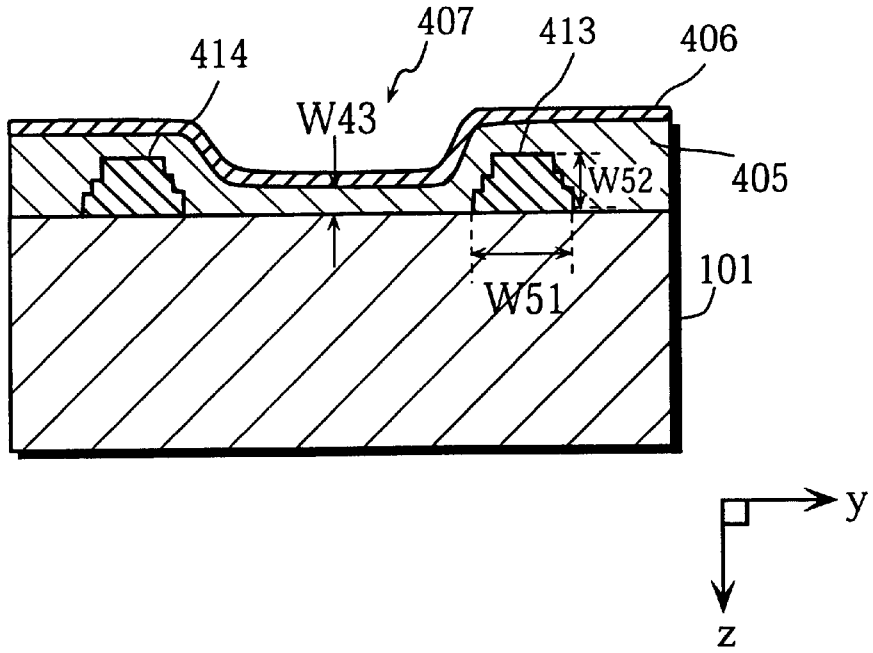
FIG. 24 is a partial expanded sectional view of a modification of the PDP of the fourth embodiment.

FIG. 24 is an expanded sectional view of part of a front panel according to this modification.

In this front panel, a display electrode 413 and a display scan electrode 414 are pyramidal in cross section.

In general, the following problem tends to occur when forming an electrode on a front glass substrate. While the electrode is being fired, the electrode material shrinks and as a result the ends of the electrode warp upward. This causes the electrode to peel away from the surface of the front glass substrate to which it is adhered. According to this modification, however, the electrode is shaped in pyramid, which means the amount of electrode material is small in the top portion of the pyramidal electrode. Therefore, the shrinkage stress in the warping direction which acts on the electrode during the firing step is decreased, thereby suppressing the occurrence of the above problem. Also, with the pyramidal shape of each of the display electrode 413 and the display scan electrode 414, the contact area between the dielectric layer 405 and each of the display electrode 413 and the display scan electrode 414 widens, which strengthens the adherence of the dielectric layer 405 to the two electrodes 413 and 414.

(2) The fourth embodiment describes the case where the groove 407 is provided in the area surrounded on three sides by the display electrode 403, the display scan electrode 404, and the front glass substrate 101, so as to heighten the electric field strength between the two electrodes 403 and 404. However, even when the groove 407 does not exist in that area or does not exit at all, if the aspect ratio of each of the electrodes is higher than that in the conventional art, the opening ratio of the panel increases, with it being possible to improve the luminous efficiency.

Figure 25:
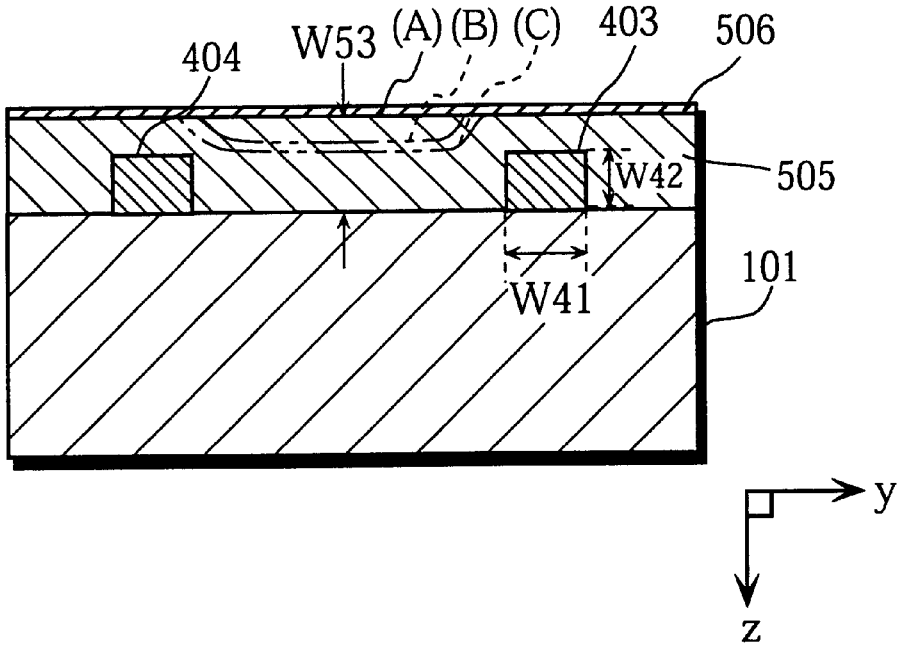
FIG. 25 is a partial expanded sectional view of a modification of the PDP of the fourth embodiment.

FIG. 25 is an expanded sectional view of part of a front panel according to this modification.

In this front panel, the thickness W53 of a dielectric layer 505 between the display electrode 403 and the display scan electrode 404 is set larger than the thickness W42 of each of the electrodes 403 and 404. The dielectric layer 505 either has no groove (shown by (A) in FIG. 25), or has a groove but its bottom does not reach the area surrounded on three sides by the display electrode 403, the display scan electrode 404, and the front glass substrate 101 (shown by (B) and (C) in FIG. 25).

The aspect ratio of each of the display electrode 403 and the display scan electrode 404 in this front panel is equal to that of the fourth embodiment, which is higher than the conventional aspect ratio (about 0.05). Accordingly, the panel's opening ratio increases, which benefits the luminous efficiency of the panel.

When the dielectric layer 505 is provided with a groove whose bottom does not reach the area surrounded on three sides by the display electrode 403, the display scan electrode 404, and the front glass substrate 101 (shown by (B) and (C) in FIG. 25), the electric flux line between the two electrodes 403 and 404 increases and so the electric field strength increases, with it being possible to reduce the panel's power consumption.

(3) The fourth embodiment describes the case where the groove 407 is provided to form an area having a low relative permittivity in the area surrounded on three sides by the display electrode 403, the display scan electrode 404, and the front glass substrate 101. Alternatively, a dielectric layer such as the second dielectric layer 1052 in the first embodiment may be provided in the area surrounded on three sides by the display electrode 403, the display scan electrode 404, and the front glass substrate 101. In so doing, the panel's power consumption can be reduced for the same reason as explained in the fourth embodiment.

(4) Also, a hollow may be provided instead of the groove 407 in the area surrounded on three sides by the display electrode 403, the display scan electrode 404, and the front glass substrate 101, as in the third embodiment.

(Third Experiment)

The following PDP samples were prepared, with their front panels having a construction similar to those in the first experiment but differing in size and/or shape of the display electrode and display scan electrode.

(Sample No. 20)

A PDP sample No. 20 was prepared with its display electrode and display scan electrode being rectangular in cross section, as shown in FIG. 23. The display electrode and the display scan electrode were 30 $\mu$m in width and 15 $\mu$m in thickness (the aspect ratio of 0.5). The spacing between the two electrodes was 100 $\mu$m.

(Sample No. 21)

A PDP sample No. 21 was prepared with its display electrode and display scan electrode being pyramidal in cross section, as shown in FIG. 24. The display electrode and the display scan electrode were 50 $\mu$m in width on the side of the front glass substrate, and 15 $\mu$m in thickness (the aspect ratio of 0.3). The spacing between the two electrodes was 100 $\mu$m.

(Samples Nos. 22–24)

PDP samples Nos. 22–24 were prepared. In each of these samples, the display electrode and the display scan electrode were in the same size as the sample No. 20, and the thickness W53 of the dielectric layer between the display electrode and the display scan electrode was greater than the thickness W42 (15 $\mu$m) of each electrode, as shown in FIG. 25. In the sample No. 22, the thickness W53 of the dielectric layer was 40 $\mu$m (shown by (A) in FIG. 25). In the sample No. 23, the thickness W53 was 30 $\mu$m (shown by (B) in FIG. 25). In the sample No. 24, the thickness W53 was 15 $\mu$m ((C) in FIG. 25). In each of the samples Nos. 22–24, the display electrode and the display scan electrode were 30 $\mu$m in width and 15

μm in thickness (the aspect ratio of 0.5). The spacing between the two electrodes was 100 μm. The thickness of the dielectric layer other than the part between the display electrode and the display scan electrode was 40 μm.

(Sample No. 25)

A PDP sample No. 25 was prepared with a construction similar to the sample No. 22, where the display electrode and the display scan electrode were shaped in pyramid as the sample No. 21.

(Comparative Sample No. 26)

A PDP sample No. 26 was prepared with its display electrode and display scan electrode being shaped like a thin flat plate, as shown in FIG. 2. The display electrode and the display scan electrode were 100 μm in width and 5 μm in thickness (the aspect ratio of 0.05).

(Experimental Conditions)

Each of the samples Nos. 20–26 was connected to a PDP drive device of the same construction, and the sustain discharge voltage, the relative luminous efficiency, and the amount of required power at the time of driving the PDP were measured. Here, the input waveform of each of the display electrode and the display scan electrode was a rectangular wave having a frequency of 10 kHz and a duty factor of 10%.

(Results and Consideration)

The experimental results are shown in TABLE 3 (FIG. 28).

As can be seen from the table, the comparative sample No. 26 required 340V of voltage and 42 W of power for sustain discharge, and exhibited a relative luminous efficiency of 0.50 (1 m/W).

On the other hand, each of the samples Nos. 20 and 21 required no greater than 37 W of power and no greater than 320V of voltage, demonstrating an approximately 6% or greater reduction in sustain discharge voltage and power consumption in comparison with the sample No. 26. Also, the relative luminous efficiency was 0.71 (1 m/W) or higher, showing a 40% or greater improvement in comparison with the sample No. 26. Further, no illumination failures were seen in these samples.

In each of the samples Nos. 22–25, the sustain discharge voltage decreased and the luminous efficiency increased as the dielectric layer between the display electrode and the display scan electrode became thinner. Even in the sample No. 22 in which no groove was provided between the display electrode and the display scan electrode, the aspect ratio of each electrode was higher than the conventional art, so that the luminous efficiency was improved when compared with the sample No. 26. The same applies to the case where the display electrode and the display scan electrode were shaped in pyramid, as demonstrated by the sample No. 25.

The following conclusion can be drawn from the experimental results. By setting the aspect ratio of each of the display electrode and the display scan electrode higher than the conventional art, the luminous efficiency can be improved significantly. Also, by providing a groove in the area surrounded on three sides by the display electrode, the display scan electrode, and the front glass substrate, the power consumption during sustain discharge can be reduced without causing illumination failures, as in the second embodiment.

Modifications to the First to Fourth Embodiments

The above embodiments describe the case where the barrier ribs have a stripe shape, but this is not a limit for the invention. The barrier ribs may be arranged in a lattice pattern in which auxiliary barrier ribs are provided between neighboring barrier ribs. Alternatively, the barrier ribs may be shaped in meandering lines.

The above embodiments describe the case where the invention is used for a PDP, though this is not a limit for the invention, which may be used in other applications such as a PALC that has a surface discharge structure like a PDP. Also, the display electrodes and display scan electrodes are formed from silver in the above embodiments, but they may be formed from other materials. Further, well-known transparent electrodes may be added as auxiliary electrodes for the display electrodes and display scan electrodes. In this case, the aspect ratio of the transparent electrodes need not be limited.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

TABLE 1

| SAMPLE NUMBER | SECOND DIELECTRIC LAYER | FORMATION METHOD | SUSTAIN DISCHARGE VOLTAGE (V) | LUMINOUS EFFICIENCY (1 m/W) | REQUIRED POWER (W) |
|---|---|---|---|---|---|
| 1 | $Na_2O—B_2O_3—ZnO$ | METAL MASKING | 245 | 0.61 | 62 |
| 2 | $SiO_2$ | NOZZLE INJECTION | 250 | 0.62 | 58 |
| 3 | $Na_2O—B_2O_3—ZnO$ | METAL MASKING | 240 | 0.67 | 55 |
| 4 | $Na_2O—B_2O_3—ZnO$ | NOZZLE INJECTION | 245 | 0.65 | 56 |
| 5 | $SiO_2$ | NOZZLE INJECTION | 250 | 0.65 | 57 |
| 6 | $Na_2O—B_2O_3—ZnO$ | METAL MASKING | 265 | 0.63 | 57 |
| 7 | $SiO_2$ | NOZZLE INJECTION | 255 | 0.62 | 58 |
| 8 | | | 240 | 0.60 | 66 |

TABLE 2

| SAMPLE NUMBER | DISCHARGE GAS PRESSURE (kPa) | SUSTAIN DISCHARGE VOLTAGE (V) | LUMINOUS EFFICIENCY (1 m/W) | REQUIRED POWER (W) |
|---|---|---|---|---|
| 9 | 66.5 | 290 | 0.61 | 35 |
| 10 | 66.5 | 300 | 0.58 | 37 |
| 11 | 320 | 360 | 1.41 | 53 |
| 12 | 66.5 | 290 | 0.62 | 34 |
| 13 | 320 | 370 | 1.53 | 48 |
| 14 | 66.5 | 290 | 0.58 | 35 |
| 15 | 320 | 370 | 1.36 | 55 |
| 16 | 66.5 | 285 | 0.63 | 36 |
| 17 | 320 | 350 | 1.48 | 56 |
| 18 | 66.5 | 340 | 0.50 | 42 |
| 19 | 320 | 430 | 1.18 | 66 |

TABLE 3

| SAMPLE NUMBER | ELECTRODE SHAPE | ASPECT RATIO | DISCHARGE GAS PRESSURE (kPa) | SUSTAIN DISCHARGE VOLTAGE (V) | LUMINOUS EFFICIENCY (1 m/W) | REQUIRED POWER (W) |
|---|---|---|---|---|---|---|
| 20 | RECTANGLE | 0.50 | 66.5 | 320 | 0.72 | 37 |
| 21 | PYRAMID | 0.30 | 66.5 | 315 | 0.71 | 36 |
| 22 | RECTANGLE(W53 = 40 $\mu$m) | 0.50 | 66.5 | 345 | 0.64 | 41 |
| 23 | RECTANGLE(W53 = 30 $\mu$m) | 0.50 | 66.5 | 335 | 0.66 | 42 |
| 24 | RECTANGLE(W53 = 15 $\mu$m) | 0.50 | 66.5 | 320 | 0.71 | 36 |
| 25 | PYRAMID(W53 = 40 $\mu$m) | 0.50 | 66.5 | 340 | 0.61 | 42 |
| 26 | FLAT PLATE | 0.05 | 66.5 | 340 | 0.50 | 42 |

What is claimed is:

1. A surface-discharge type display device comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrates, wherein a second dielectric layer which is different from the first dielectric layer is formed in the area surrounded on three sides by the first electrode, the second electrode, and the first substrate, the second dielectric layer having a lower relative permittivity than the first dielectric layer.

2. The surface-discharge type display device of claim 1, wherein the second dielectric layer is no thinner than any of the first and second electrodes.

3. The surface-discharge type display device of claim 1, wherein the second dielectric layer is made of a dielectric material that contains sodium.

4. The surface-discharge type display device of claim 3, wherein the dielectric material is $Na_2O—B_2O_3—ZnO$.

5. The surface-discharge type display device of claim 1, wherein the first dielectric layer is made of a dielectric material that contains lead.

6. The surface-discharge type display device of claim 5, wherein the dielectric material is $PbO—B_2O_3—SiO_2$.

7. The surface-discharge type display device of claim 1, wherein an aspect ratio that is a ratio of a thickness to a width of each of the first and second electrodes is in a range of 0.07 to 2.0 inclusive.

8. The surface-discharge type display device of claim 7, wherein the aspect ratio is in a range of 0.15 to 2.0 inclusive.

9. The surface-discharge type display device of claim 7, wherein the thickness of each of the first and second electrodes is in a range of 3 $\mu$m to 20 $\mu$m inclusive, and the width of each of the first and second electrodes is in a range of 43 $\mu$m to 70 $\mu$m inclusive.

10. The surface-discharge type display device of claim 7, wherein each of the first and second electrodes has a pyramidal cross section which becomes wider in a direction toward the first substrate.

11. The surface-discharge type display device of claim 1, wherein the area that has the lower relative permittivity than the first dielectric layer is an area which is not part of the first dielectric layer but part of the discharge spaces.

12. The surface-discharge type display device of claim 11, wherein a groove is formed, between the first and second electrodes, in a main surface of the first dielectric layer facing the second panel, in such a way that a bottom of the groove is closer to the first substrate than any of surfaces of the first and second electrodes facing the second panel, the groove thereby forming the area that has the lower relative permittivity than the first dielectric layer.

13. The surface-discharge type display device of claim 12, wherein part of the first dielectric layer is interposed between the first substrate and each of the first and second electrodes.

14. The surface-discharge type display device of claim 11, wherein at least one of the first and second electrodes is inclined toward the first substrate so that one side of the inclined electrode facing the other electrode is closer to the first substrate than the other side.

15. The surface-discharge type display device of claim 1, wherein the first dielectric layer is coated with a protective film which has a gap between the first and second electrodes.

16. The surface-discharge type display device of claim 1, wherein the first dielectric layer is made of a dielectric material that contains lead.

17. The surface-discharge type display device of claim 16, wherein the dielectric material is $PbO—B_2O_3—SiO_2$.

18. The surface-discharge type display device of claim 1, wherein an aspect ratio that is a ratio of a thickness to a width of each of the first and second electrodes is in a range of 0.07 to 2.0 inclusive.

19. The surface-discharge type display device of claim 18, wherein the aspect ratio is in a range of 0.15 to 2.0 inclusive.

20. The surface-discharge type display device of claim 1, wherein the thickness of each of the first and second electrodes is in a range of 3 $\mu$m to 20 $\mu$m inclusive, and the width of each of the first and second electrodes is in a range of 43 $\mu$m to 70 $\mu$m inclusive.

21. The surface discharge type display device of claim 1, wherein each of the first and second electrodes has a pyramidal cross section which becomes wider in a direction toward the first substrate.

22. The surface-discharge type display device of claim 1, wherein a hollow is formed, between the first and second electrodes, in a main surface of the first dielectric layer facing the second panel, in such a way that a bottom of the hollow is closer to the first substrate than any of surfaces of the first and second electrodes facing the second panel, the hollow thereby forming the area that has the lower relative permittivity than the first dielectric layer.

23. The surface-discharge type display device of claim 22, wherein part of the first dielectric layer is interposed between the first substrate and each of the first and second electrodes.

24. The surface-discharge type display device of claim 23, wherein at least one of the first and second electrodes is inclined toward the first substrate so that one side of the inclined electrode facing the other electrode is closer to the first substrate than the other side.

25. A surface-discharge type display device comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate;

wherein the area that has the lower relative permittivity than the first dielectric layer is an area which is not part of the first dielectric layer but part of the discharge spaces, wherein the area is a groove formed between the first and second electrodes, in a main surface of the first dielectric layer facing the second panel, in such a way that a bottom of the groove is closer to the first substrate than any of surfaces of the first and second electrodes facing the second panel, the groove thereby forming the area that has the lower relative permittivity than the first dielectric layer, wherein part of the first dielectric layer is interposed between the first substrate and each of the first and second electrodes, wherein at least one of the first and second electrodes is inclined toward the first substrate so that one side of the inclined electrode facing the other electrode is closer to the first substrate than the other side.

26. A surface-discharge type display device comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate, wherein the area that has the lower relative permittivity than the first dielectric layer is an area which is not part of the first dielectric layer but part of the discharge spaces, wherein the area is a groove formed between the first and second electrodes, in a main surface of the first dielectric layer facing the second panel, in such a way that a bottom of the groove is closer to the first substrate than any of surfaces of the first and second electrodes facing the second panel, the groove thereby forming the area that has the lower relative permittivity than the first dielectric layer, and wherein the first dielectric layer is coated with a protective film which has a gap between the first and second electrodes.

27. The surface-discharge type display device of claim 7, wherein the gap in the protective film is formed at the bottom of the groove.

28. A surface-discharge type display device comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate, wherein the area that has the lower relative permittivity than the first dielectric layer is an area which is not part of the first dielectric layer but part of the discharge spaces, wherein the area is a groove formed between the first and second electrodes, in a main surface of the first dielectric layer facing the second panel, in such a way that a bottom of the groove is closer to the first substrate than any of surfaces of the first and second electrodes facing the second panel, the groove thereby forming the area that has the lower relative permittivity than the first dielectric layer, wherein an aspect ratio that is a ratio of a thickness to a width of each of the first and second electrodes is in a range of 0.07 to 2.0 inclusive, and wherein each of the first and second electrodes has a pyramidal cross section which becomes wider in a direction toward the first substrate.

29. A surface-discharge type display device comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate, wherein the area that has the lower relative permittivity than the first dielectric layer is an area which is not part of the first dielectric layer but part of the discharge spaces, wherein the area is a hollow formed between the first and second electrodes, in a main surface of the first dielectric layer facing the second panel, in such a way that a bottom of the hollow is closer to the first substrate than any of surfaces of the first and second electrodes facing the second panel, the hollow thereby forming the area that has the lower relative permittivity than the first dielectric layer, wherein part of the first dielectric layer is interposed between the first substrate and each of the first and second electrodes, and wherein at least one of the first and second electrodes is inclined toward the first substrate so that one side of the inclined electrode facing the other electrode is closer to the first substrate than the other side.

30. The surface-discharge type display device of claim 29, wherein the first dielectric layer is coated with a protective film which has a gap between the first and second electrodes.

31. The surface-discharge type display device of claim 30, wherein the gap in the protective film is formed at the bottom of the hollow.

32. The surface-discharge type display device of claim 29, wherein the first dielectric layer is made of a dielectric material that contains lead.

33. The surface-discharge type display device of claim 32, wherein the dielectric material is $PbO—B_2O_3—SiO_2$.

34. The surface-discharge type display device of claim 29, wherein an aspect ratio that is a ratio of a thickness to a width of each of the first and second electrodes is in a range of 0.07 to 2.0 inclusive.

35. The surface-discharge type display device of claim 34, wherein the aspect ratio is in a range of 0.15 to 2.0 inclusive.

36. The surface-discharge type display device of claim 34, wherein the thickness of each of the first and second electrodes is in a range of 3 $\mu$m to 20 $\mu$m inclusive, and the width of each of the first and second electrodes is in a range of 43 $\mu$m to 70 $\mu$m inclusive.

37. The surface-discharge type display device of claim 29, wherein each of the first and second electrodes has a pyramidal cross section which becomes wider in a direction toward the first substrate.

38. A surface-discharge type display device comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate, wherein the area that has the lower relative permittivity than the first dielectric layer is an area which is not part of the first dielectric layer but part of the discharge spaces, wherein the area is a hollow formed between the first and second electrodes, in a main surface of the first dielectric layer facing the second panel, in such a way that a bottom of the hollow is closer to the first substrate than any of surfaces of the first and second electrodes facing the second panel, the hollow thereby forming the area that has the lower relative permittivity than the first dielectric layer, wherein an aspect ratio that is a ratio of a thickness to a width of each of the first and second electrodes is in a range of 0.07 to 2.0 inclusive, and wherein each of the first and second electrodes has a pyramidal cross section which becomes wider in a direction toward the first substrate.

39. A plasma display panel comprising:

a first panel including a first substrate and a plurality of electrode pairs which are aligned on a main surface of the first substrate and are each made up of a first electrode and a second electrode; and a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate, and wherein a second dielectric layer which is different from the first dielectric layer is formed in the area surrounded on three sides by the first electrode, the second electrode, and the first substrate, the second dielectric layer having a lower relative permittivity than the first dielectric layer.

40. The surface-discharge type display device of claim 39, wherein the thickness of each of the first and second electrodes is in a range of 3 $\mu$m to 20$\mu$m inclusive, and the width of each of the first and second electrodes is in a range of 43 $\mu$m to 70 $\mu$m inclusive.

41. The surface-discharge type display device of claim 39, wherein each of the first and second electrodes has a pyramidal cross section which becomes wider in a direction toward the first substrate.

42. A plasma display panel comprising:

a first panel including a first substrate and a plurality of electrode pairs which are aligned on a main surface of the first substrate and are each made up of a first electrode and a second electrode;

a second panel including a second substrate, a plurality of electrodes aligned on a main surface of the second substrate, and a plurality of barrier ribs aligned on the main surface of the second substrate, the second panel being placed parallel to the first panel with the plurality of barrier ribs being interposed in between, so that the plurality of electrodes face the plurality of electrode pairs, a discharge gas being enclosed in discharge spaces which are formed between the first panel and the second panel and are separated from each other by the plurality of barrier ribs, and the surface-discharge type display device producing an image display by using a surface discharge induced between the first and second electrodes, wherein the first and second electrodes are coated with a first dielectric layer, and an area that has a lower relative permittivity than the first dielectric layer is formed in an area surrounded on three sides by the first electrode, the second electrode, and the first substrate, and wherein a second dielectric layer which is different from the first dielectric layer is formed in the area surrounded on three sides by the first electrode, the second electrode, and the first substrate, the second dielectric layer having a lower relative permittivity than the first dielectric layer; and a display drive circuit which is connected to electrodes of the PDP, and drives the PDP by applying voltages to the electrodes.

43. A method of manufacturing a surface-discharge display device comprising:

providing a first panel having a first substrate;

aligning first and second electrodes on a main surface of the first substrate;

coating a first dielectric layer on the first and second electrodes;

forming an area that has a lower relative permittivity than the first dielectric layer, the area is surrounded on three sides by the first electrode, the second electrode, and the first substrate;

applying a second dielectric layer which has a lower relative permittivity than the first dielectric layer in the area surrounded on three sides by the first electrode, the second electrode, and the first substrate;

providing a second panel having a second substrate, a plurality of electrodes aligned on a main surface of the second substrate, and a plurality of barrier ribs aligned on the main surface of the second substrate;

aligning the second panel parallel to the first panel with the plurality of barrier ribs being interposed in between, so that the plurality of electrodes face the plurality of electrode pairs to provide discharge spaces between the first and second panels; and providing a discharge gas in the discharge spaces to enable an image to be displayed by inducing a surface discharge between the first and second electrodes.

44. The method of manufacturing of claim 43 wherein a dielectric paste is applied to font the second dielectric layer.

45. The method of manufacturing of claim 44 wherein the dielectric paste is applied by one of a metal masking step and a nozzle injection step.

* * * * *

UNITED STATES PATENT AND TRADEMARK OFFICE

CERTIFICATE OF CORRECTION

PATENT NO. : 6,650,053 B2
DATED : November 18, 2003
INVENTOR(S) : Yuusuke Takada et al.

It is certified that error appears in the above-identified patent and that said Letters Patent is hereby corrected as shown below:

Column 23,
Line 58, delete “substrates” and insert -- substrate --

Column 30,
Line 62, delete “font” and insert -- form --

Signed and Sealed this

Twentieth Day of July, 2004

JON W. DUDAS
*Acting Director of the United States Patent and Trademark Office*